United States Patent [19]

Davies et al.

[11] Patent Number: 4,818,854

[45] Date of Patent: Apr. 4, 1989

[54] TICKET VENDING MACHINE

[75] Inventors: Michael L. Davies, American Fork; Lawrence Weber, Centerville, both of Utah

[73] Assignee: Unisys Corp., Detroit, Mich.

[21] Appl. No.: 939,595

[22] Filed: Dec. 8, 1986

[51] Int. Cl.[4] ..... G07F 7/02

[52] U.S. Cl. ..... 235/381; 235/384; 221/2; 221/222

[58] Field of Search ..... 235/381, 384, 432, 382, 235/383, 31 R, 31 T; 364/407, 479; 221/2, 219, 4, 220, 221, 222

[56] References Cited

U.S. PATENT DOCUMENTS

| | | | |
|---|---|---|---|
| Re. 32,115 | 4/1986 | Lockwood et al. | 235/381 |
| 4,359,631 | 11/1982 | Lockwood et al. | 235/381 |
| 4,449,186 | 5/1984 | Kelly et al. | 364/407 |
| 4,450,978 | 5/1984 | Graef et al. | 221/21 |
| 4,535,892 | 8/1985 | Roes et al. | 235/384 |
| 4,704,518 | 11/1987 | Brunn et al. | 235/381 |
| 4,721,229 | 1/1988 | Dempf et al. | 235/379 |

*Primary Examiner*—A. D. Pellinen
*Assistant Examiner*—H. L. Williams
*Attorney, Agent, or Firm*—John J. McCormack; Kevin R. Peterson

[57] ABSTRACT

An automatic ticket handling machine AT adapted for use as a ticket vending station, presenting a display screen D, a telephone receiver-speaker unit TEL and a credit card reader unit CR, etc.

Within machine AT is a sheet handling mechanism adapted to receive processed tickets (from a printer) in a "holding bin" secured within the machine which can either "dump" them or be shifted to present them to a user automatically when the user raises the access door of machine AT.

16 Claims, 15 Drawing Sheets

TICKET VENDING MACHINE

The following relates to systems and mechanisms for automatically preparing and dispensing tickets and like unit records. More particularly, it relates to such systems and mechanisms as adapted for vending such records automatically in an unattended machine.

BACKGROUND, INVENTION FEATURES

Workers in the art of handling sheets and like unit records are aware of the need for systems and automatic machinery for handling such records, such as in an unattended, user-accessible ticket vending station. For instance, airline ticket handling mechanisms are of interest, such as those which can receive about one to nine tickets from a printer, bunch them together and move them to an access window, where a customer can receive them. Such systems and mechanisms are particularly needed for handling perforated tickets which tend to problematically fold and spread and are generally not particularly easy to handle. Such mechanisms are needed which can handle perforated tickets without bending, distorting or ripping at the perforations, yet will also insure security of the tickets by allowing customer access only when a transaction (e.g., purchase of several ticket pieces) and printing and bunching of the tickets is completed and which will also safeguard and secure incompletely executed or forgotten tickets in a machine.

The subject invention is directed toward such objects and the solution of such problems.

EMBODIMENT INTRODUCTION

A preferred embodiment of the invention is shown in FIG. 1 and comprises an automatic ticket handling machine AT adapted for use as an unattended user-accessible, user-operated ticket vending station. Machine AT is shown inset into the surface of a wall which, for instance, may be a high-traffic hallway or room in an airport terminal. The facing portion of machine AT comprises a front panel FP presenting a display screen D, a telephone receiver-speaker unit TEL and a credit card reader unit CR across the upper portion of the machine, these being positioned for convenient access by customers.

The rest of the facing portion comprises a front door panel FD (see FIG. 2 also), including an upper framework surrounding panel FP and with an outwardly projected overhang Oh (e.g., for mounting lamps, speaker, etc.) and presenting an outwardly cantilevered shelf portion S (at about waist height for the customer). Door panel FD also presents a sloped panel portion SP above shelf S and extending in toward front panel FP to terminate in a skirt portion SK parallel to panel FP and nearly abutting it. Below shelf S is a lower vertical skirt LS in which a door-lock mechanism DL is mounted. Below skirt LS, there is preferably provided a storage cavity for convenient temporary reception of a customer's luggage, etc., while he is using machine AT.

FIG. 2 shows machine AT with door FD swung open to expose the inner mechanism including a ticket printer TP and a log printer LP discussed below.

Door FD, itself, mounts a ticket handling mechanism HM adapted to automatically feed tickets ejected by printer TP (e.g., see ticket TK, FIGS. 2, 2A) and present them to the customer at a port or ticket window P as detailed below. As also described below, mechanism HM includes a "cuneiform" (wedge-shaped) bin B, the lower portion of which is adapted to be selectively opened at times to dump bin contents into a receiving pocket RP according to one feature hereof.

Workers will better appreciate the problems addressed by machine AT by consideration of FIG. 2A showing in plan view and in actual dimensir'n an exemplary ticket TK, preferably of thin, light-colored, somewhat rigid paper stock. A series of unprinted tickets TK can be loaded in the printer TP in one continuous "fanfold" array, apt to be folded at a perforation f-p. Ticket TK is assumed to be severed by ticket printer TP—before ejecting it to the handling mechanism; e.g., along trailing-edge te—which also defines the leading-edge l-e of the succeeding tickets; tickets TK assumed driven in direction of arrows to be ejected from printer TP, as suggested in FIG. 2. Thus, one ticket may emerge from TP somewhat "bent" and folded along f-p in one direction, while the next ticket is likely "bent" oppositely. A hole h-i is typically present to signal "severing means". The ticket is adapted for use by the carrier and by the customer, e.g., major portion TK-1 typically given to a flight attendant or ticket-taker upon boarding an aircraft, with minor portion TK-2 kept by the passenger to identify his flight seat, baggage, etc. and essentially duplicating the information printed on portion TK-1. Sheet TK may typically be of semi-rigid paper stock (like a computer punched card), about 3–4" wide and about 8–9" long, with stub TK-2 about 2½" long and "leading portion" TK-3 about ½" long, leaving TK-1 about 5" long.

Typical operation

Workers may appreciate the following as generalizing an exemplary mode of operation. Machine AT may be communicated-with via a touch-screen TS, including matrix of IR-beams and associated receptors surrounding the CRT screen of display D, as known in the art, so that presentation of a finger on a particular site on the screen can generate a place-encoded signal to machine AT, e.g., representing selection of a certain menu-offering, of a certain flight, date, price, etc.

Thus, an instruction-display (on display D or elsewhere—or via audio advice on telephone receiver TEL) may direct a customer to initiate a ticketing sequence by inserting an approved credit card into card reader CR. The machine may then verify card validity (or do so via line to remote central data base) and then invite the customer to make his flight selection (according to routines presented on display D, but not detailed here). For example, a customer might select a sequence of (2) two flights from Los Angeles to Minneapolis via Denver, and return, at first class, with special meals, etc.—calling for (4) four tickets to be printed. Display D could show the ordered flights, etc., and call for the customer to verify, while checking his available credit.

Then, the printer would advance and separate four tickets successively, printing the necessary indicia on each and ejecting it to be advanced by mechanism HM into a holding bin B. Once the printing is finished (successfully), display D can direct the customer to remove the four tickets from bin B (and indicate that he has done so, and that the tickets are as expected, via the touch-screen). According to a security feature hereof, ticket access is preferably via a port P covered by a window P-W which is unlocked for this, while bin B is manipulated to present the four tickets, with machine AT, thereafter, requiring that window P-W be fully-closed and machine-locked before a succeeding transaction can be initiated [as detailed below—note locking pin lp and switch ms in FIG. 4A].

According to another feature hereof, the customer's translation of window P-W causes bin B to pivot and present its contents at port P, the bin being self-returned upon release of window P-W (self-closing). According to a related feature, this pivoting of bin B also causes a pressure plate to press the packet of tickets together for easier handling by the customer.

According to a further related feature, bin B is provided with a ticket-sensor and a "trap-door" panel which may be opened to "dump" bin contents into receiving pocket RP (e.g., when ticket-sensor indicates one or several tickets are left in bin B; or when something malfunctions in the course of printing the ordered series of tickets—in the latter case, one may visualize a malfunction like running out of ticket-stock after printing two of the four tickets ordered here; this would be problematic if the two printed had already been dispensed to the customer, or had to be later, since he might not want less than the set of four; also partial-billing is not easily implemented in such a case). Workers will perceive that bin B, with locked window P-W, offers an unexpectedly advantageous way of "short-circuiting" dispensing of tickets before printing is complete—something the art is in need of. In like fashion, bin B may be ordered to "dump" should anything else interrupt the transaction—e.g., the customer changes his mind, calls for a different itinerary, power goes "down", before printing and billing are complete, etc. Machines which dispense tickets in a set, as printed, lack this protection—as do machines which collect the set at an access station which will necessarily open up for customer access.

BRIEF DESCRIPTION OF THE DRAWINGS

These and other features and advantages of the present invention will be appreciated by workers as they become better understood by reference to the following detailed description of the present preferred embodiments which should be considered in conjunction with the accompanying drawings, wherein like reference symbols denote like elements:

FIG. 1 is a front elevation of an automatic ticket vending machine embodiment AT, while

FIGS. 9A, 9B are a respective schematic front view and side view of a press plate mechanism fp shown mounted for selective rotation inside bin B as described hereinafter, while

The invention will be better appreciated by workers upon consideration of the following detailed description of some preferred embodiments.

DESCRIPTION OF PREFERRED EMBODIMENTS

General description, background

The following illustrates an automatic ticket vending machine example according to principles of this invention.

This, and other means discussed herein, will generally be understood as selected, formulated, and operating as presently known in the art, except where otherwise specified. And, except as otherwise specified, all materials, methods, and devices and apparatus herein will be understood as implemented by known best expedients according to present good practice.

HANDLING MECHANISM

According to one salient feature hereof, handling mechanism HM is adapted for surprising and unexpectedly advantageous handling of tickets TK, transporting them from ticket printer TP (see sample ticket TK projecting therefrom in FIG. 2) to be stored in wedge-shaped bin B and presented at an appropriate selected time to the customer at port P. Until then, no customer-access to tickets is allowed.

Figure 4:
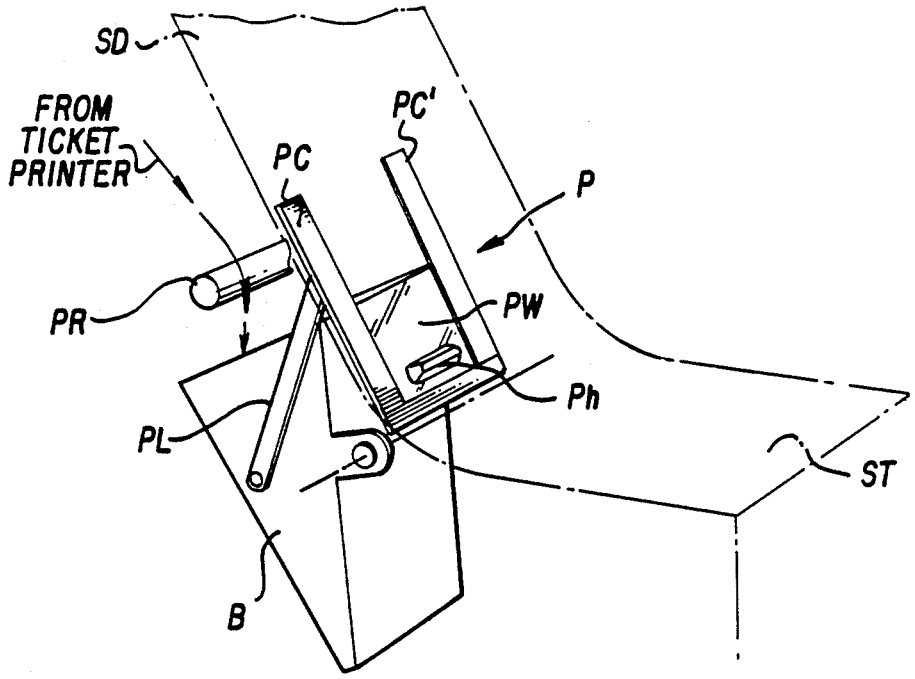
FIG. 4 is a simplified schematic showing correlating the port window PW', bin B' and pinch roll PR which are preferably provided for transporting tickets TK from ticket printer TP and advancing them into bin B' according to another feature hereof, with FIG. 4A showing the window in operative association with associated lock means and closing-switch means.

FIG. 4 is a simplified schematic showing correlating the port window PW', bin B' and pinch roll PR which is preferably provided for transporting tickets TK from ticket printer TP and advancing them into bin B' according to another feature hereof.

Figure 4A:
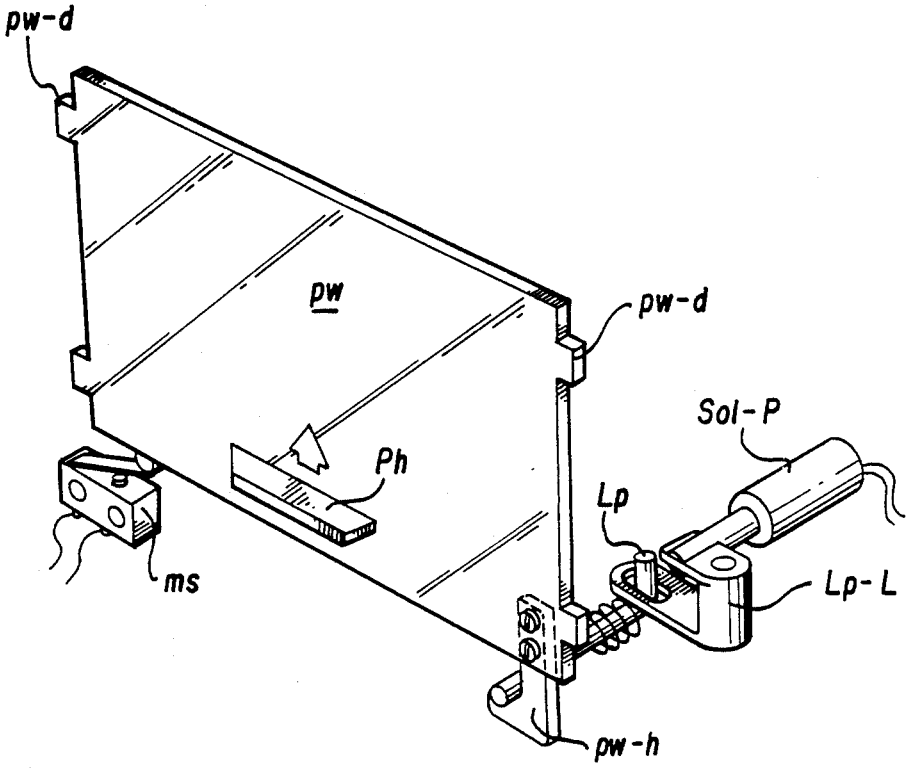

The port P, or access opening (e.g., about 2.8" by 4.5") is preferably covered by a transparent closure-window PW' (e.g., shown "closed" here, as in FIG. 7) or like movable closure (see FIG. 4A too). Window PW' will be seen to include a handle portion Ph' projected toward the customer and adapted so the customer may slide window PW' upward and hold it open to get access to the contents of bin B'—but, according to this feature, he may do so only when allowed by the controls of machine AT. That is, in its normal "down" ("closed") position, window PW' will be apt to be locked by suitable means, such as with a removable locking pin LP adapted, under the control of the program of machine AT (discussed below), to be inserted in place and prevent opening of window PW'. When the machine controls enable it, this pin LP may be withdrawn by solenoid means "SOL-P" (FIGS. 4A, 7), or the like, as known in the art.

FIG. 4A shows a like window pw with such a locking means (see latching-hook pw-h adapted to receive locking pin Lp to hold window down until solenoid SOL-P moves Lp away—and note return spring and suitable connector linkage Lp-L coupling Lp to SOL-P, as known in the art). Also shown is an exemplary "window-closed" detector means, i.e., a microswitch ms adapted to be activated (e.g., contacts "made", generate signal s-2, FIG. 11) upon full-down closure of window PW, as known in the art.

Figure 6:
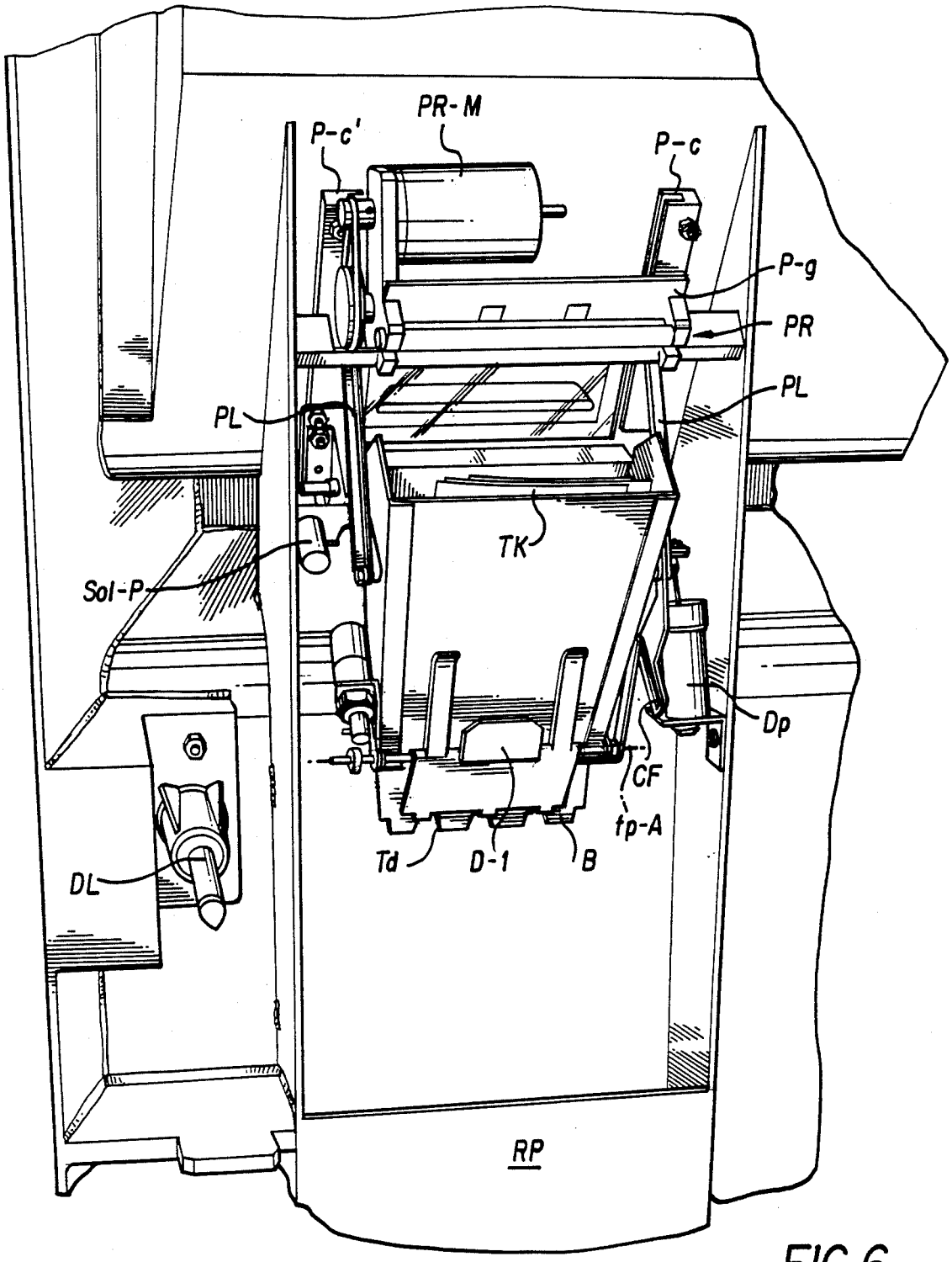
FIG. 6 is an enlarged view of the handling mechanism HM shown in FIG. 2.
Figure 6A:
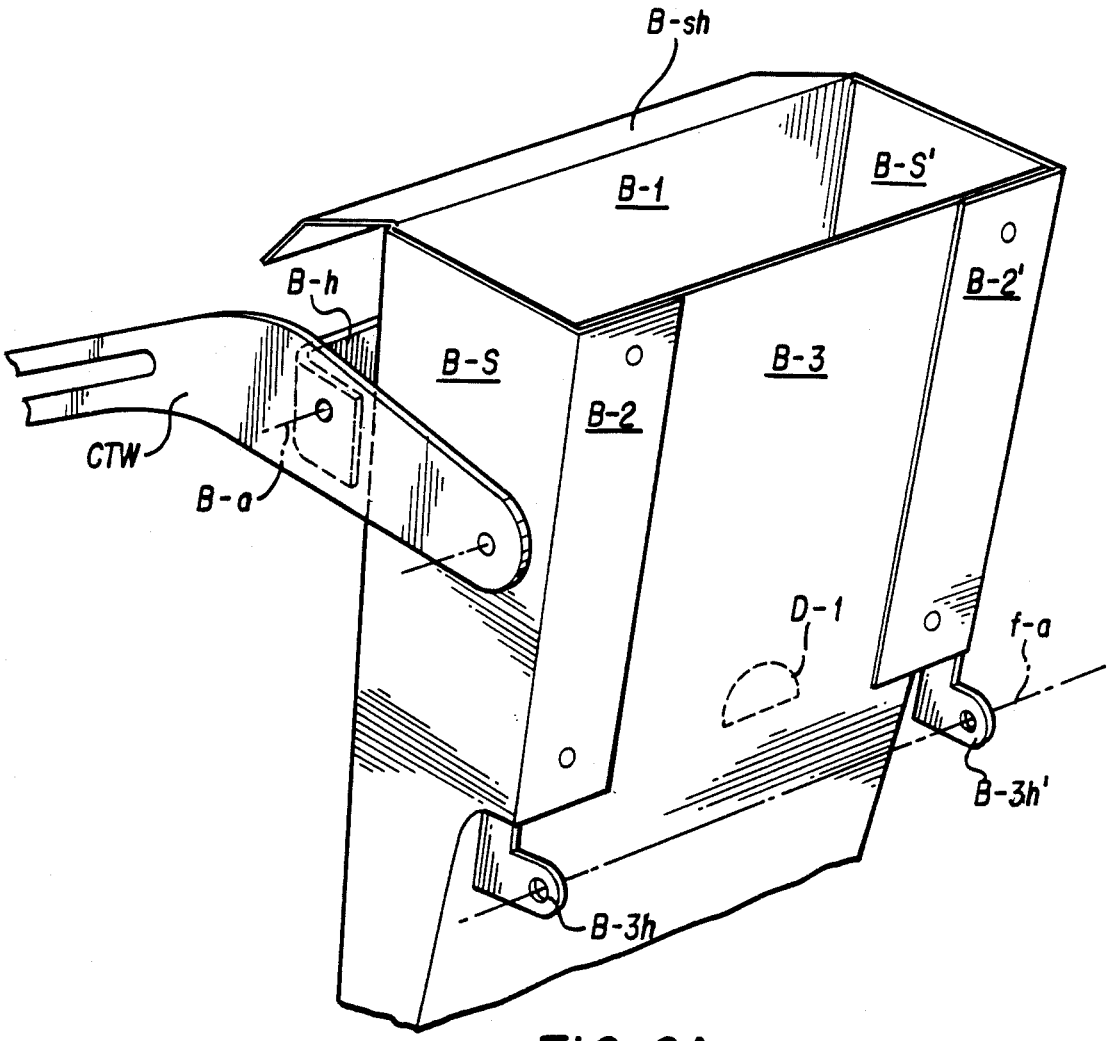
FIG. 6A is a perspective of bin B thereof.

Window PW' will be seen as slidably fit between a pair of flanking left and right guide-channel means PC, PC' (e.g., see FIGS. 4, 4A especially; note window-detents pw-d adapted to be received for sliding in such guide channel means). Bin B will be seen (FIGS. 6–8 also) to be formed between a pair of front and rear segments B-1, B-2, respectively, with a trap door portion Td and a solenoid that pivots Td "open" (see phantom view in FIG. 7). These segments B-1, B-2 are joined by a pair of opposed left and right cuneiform side-walls B-S, B-S'. The entire bin structure is preferably formed of sheet metal, as known in the art. For instance, as seen in FIG. 6A four sides may be formed from a single piece of sheet metal [see B-S, B-1, B-S' and projections B-2, B-2', joined by a plate B-3, riveted to B-2, B-2', as known in the art—preferably plate B-3 also includes a pair of flanking hangar-tabs B-3h, B-3h' with a hole for receiving an axle f-a as noted below]. Preferably, a shield-extension B-sh, or lip, is also provided along the top bin edge nearest port P (see FIG. 6A) to block access to other than bin B and give a "clean look" to the customer.

Figure 7:
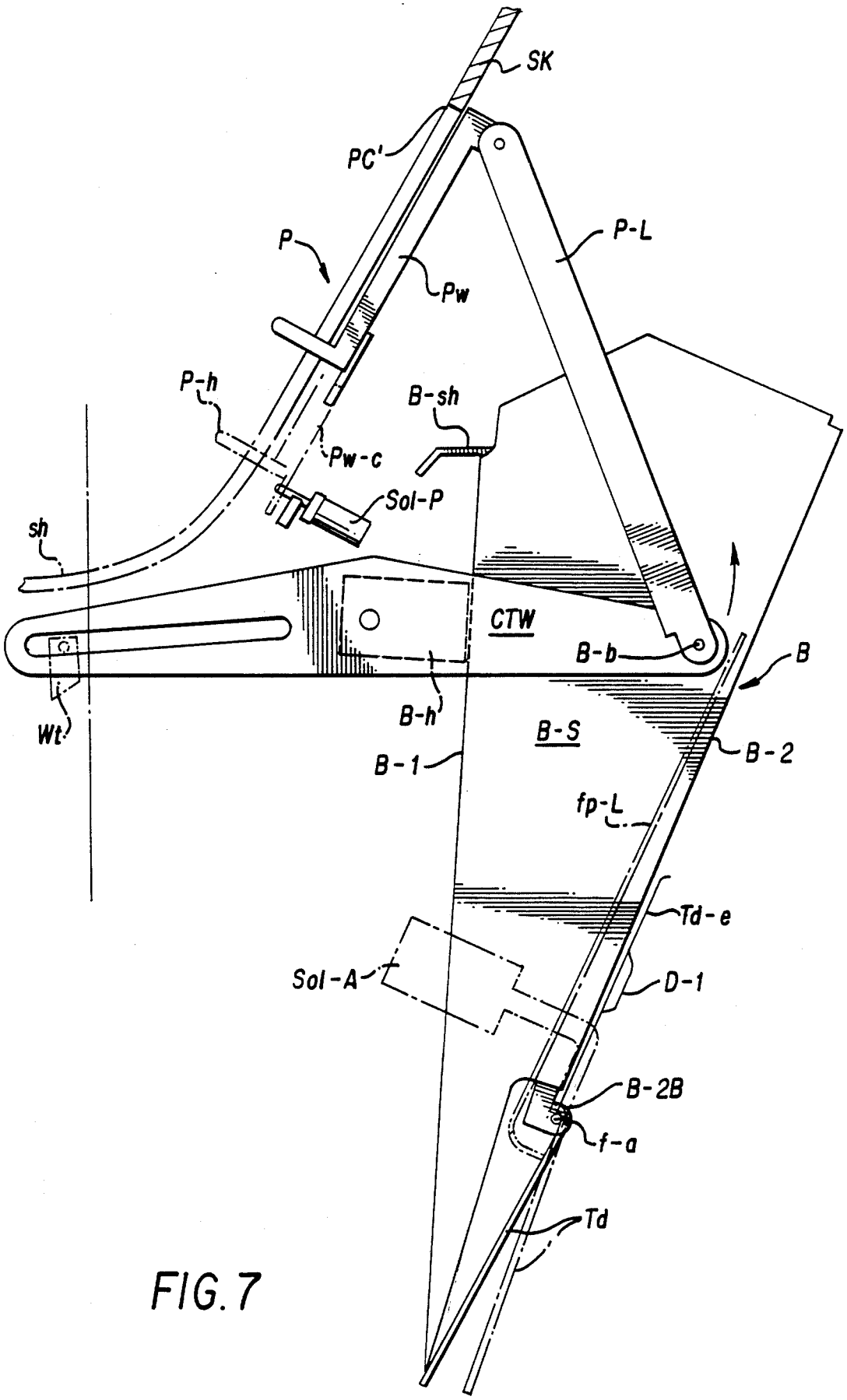
FIG. 7 is a rather schematic, sectional, enlarged side view of bin B disposed in "ticket-receiving" condition (also seen in FIG. 6A, in perspective); also shown is associated inclined panel SP and the part and window parts associated therewith.
Figure 8:
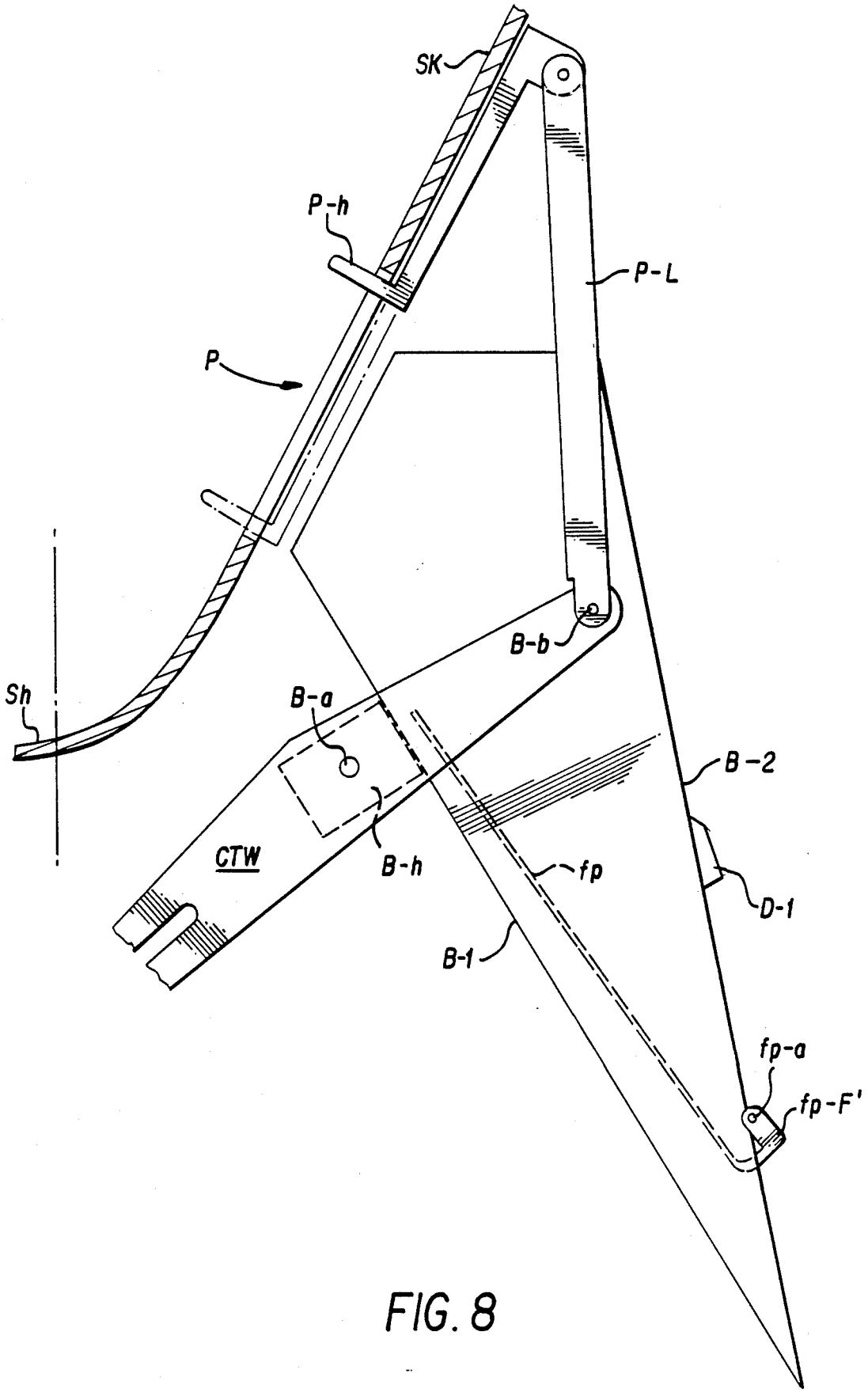
FIG. 8 is similar to FIG. 7 with bin B shown rotated into "ticket-presenting" condition, the bin having been so rotated in conjunction with the raising of window PW (to open port P and enable customer access therethrough to the tickets or other contents in bin B).

According to a feature hereof, bin B is preferably pivotable from the "receiving" position shown in FIG. 7 to the "dispensing" position shown in FIG. 8, being mounted on a suitable axle therefor B-a via a projecting hangar means B-h, or block cut out to journal axle B-a which is affixed rotatably in the machine frame. Flanking either side B-S, B-S', of bin B are a pair of counter-weighted arms CTW, CTW', each attached to hangar B-h and adapted to rotate on axle B-a. Counter-weight arms CTW, CTW' are each rotatably attached to the end of a respective window-linkage P-L, P-L' via a respective pin B-b, B-b', so that raising window PW will rotate the distal end of each arm CTW, CTW' (see arrow FIG. 7) toward port P; also so-rotating bin B. Arms CTW, CTW' extend rather symmetrically about common axle B-a (on machine AT) on which they are rotatably mounted to afford easy counter-weighting (e.g., see weight wt FIG. 7). Thus, each counter-weight arm is rotated about common axle B-a and adapted to project an arm of sufficient length (and weight) opposite bin B as to render the manual pivoting of bin B relatively easy and slightly weighted in the closing direction (for this purpose a weight wt may be attached at a selectable position along the indicated slot of the lever-arm, as workers may desire). The counter-weight means CTW, CTW' are provided to assure smooth, controlled, low-force, self-return of bin B from its "access" position in FIG. 8 to the "receiving" position in FIG. 7, as known in the art.

According to a related feature the preferred way of so manipulating bin B is to couple it to window PW so that when a customer slides PW from the "closed" to the "fully-open" position, he will also rotate bin B to the "dispensing" position—and without need for other motive means. To do this a pair of coupling arms PL, PL' are mounted rotatably between a respective side of window PW and a respective end of a counter-weight arm CTW, CTW', these dimensioned so that, at the "full-up" position of window PW (e.g., shown "fully-open" in FIG. 8—note handle P-H at the extreme upward position), bin B will be pivoted to "dispensing" position. Bin B is thus suitably rotated to dispense its contents to the customer—who presumably is holding-up window PW with one hand and can access bin B with his other hand.

As another feature, workers will note that bin B is so coupled to be moved with window PW without piercing of bin sides [similarly re mounting of trap-door and pressure plate]; yet PW will "self-close" unless held open.

Of course, other like ways are contemplated whereby opening of the access port serves to automatically thrust a ticket-storage-bin, or like receptacle, into "access condition", adjacent the port. Thus, for instance, workers will perceive that a window like pw may, instead, be opened by the customer pulling it toward himself (as "opening a drawer") and thereby draw bin B into "access condition".

The masses of the window PW, bin B with attachments, counter-weights CTW, CTW', linkages, etc. may cause this inter-coupled structure to tend to noisily "crash" against adjacent members. To eliminate or attenuate this, we provide suitable dashpot means or the like, e.g., see dashpot Dp in FLG. 6 mounted on machine frame and coupled, via a linkage to bin B (dashpot in FIG. 4 is otherwise placed). The window PW is hung to be "self-closing" (will slowly drop to "fully-closed" position, under drag of dashput)—unless the operator holds it open. To monitor window-closed" condition, a microswitch ms, or like means, is disposed to be activated (e.g., "closed" when the window is closed—see FIG. 4A).

According to a related feature, bin B is made selectively "purgible"; that is, responsive to a machine signal, the contents of the bin may be automatically dumped, released and removed from customer-access. Here, this is preferably effected by solenoid pivoting of a trap door plate Td, extending the lower portion of back wall B-2 to front wall B-1 as seen in FIG. 7. This releases the contents of bin B to drop, under gravity, into receiving pocket RP positioned below—whence they may be recovered by service personnel, etc. This can prevent tickets from being "abandoned" in bin B by one customer and left there available for unauthorized access by a succeeding customer. As mentioned above, bin B and such a "dump" facility also afford a way of preventing tickets from being dispensed when ERROR conditions arise, e.g., misprinting or incomplete printing, "power down" in the middle of a transaction, etc.

According to a machine program (not discussed here), such a dumping operation is invoked following erroneous printing operations leading to an "error-ticket" which, instead of being presented to a subject customer, is dumped into pocket RP (this control loop may be invoked upon any such "error event", thus preventing "error-tickets" from being dispensed).

Trap Door

Figure 7A:
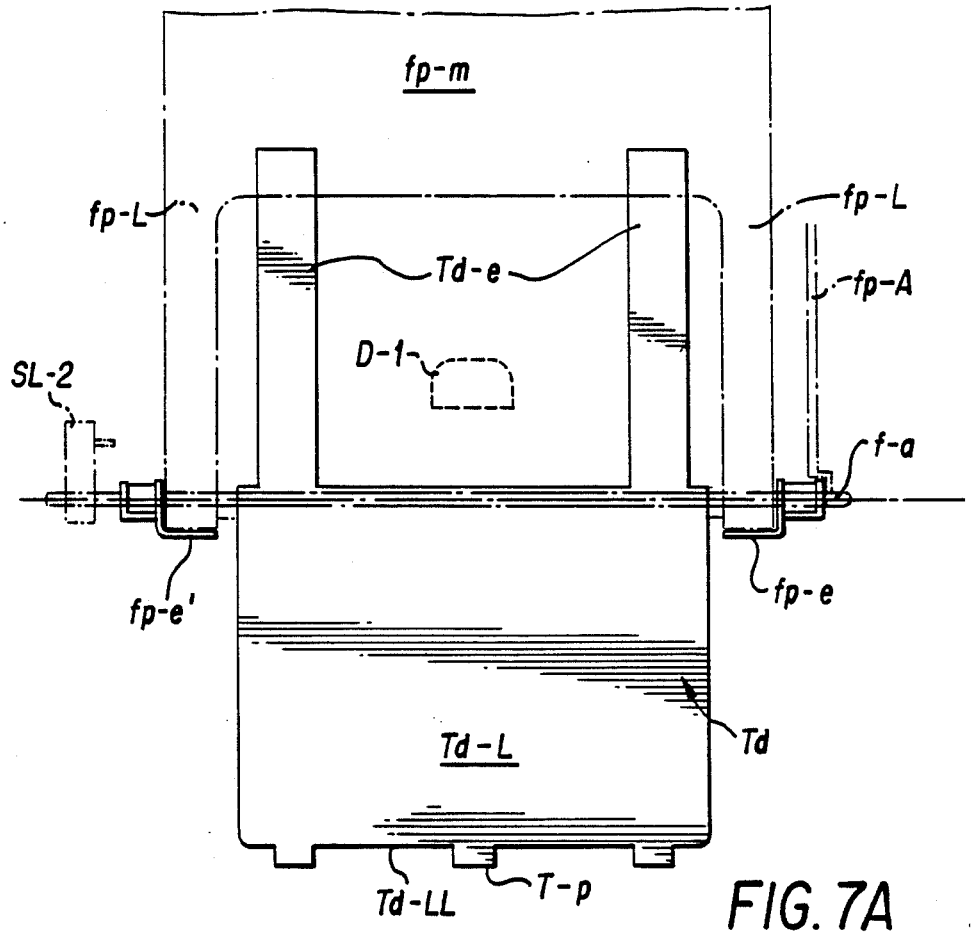
FIGS. 7A,, 7B showing a "trap-door" portion of bin B in front elevation and side elevation respectively, with FIGS. 7C, 7D showing an associated actuator inkage schematically.
Figure 7B:
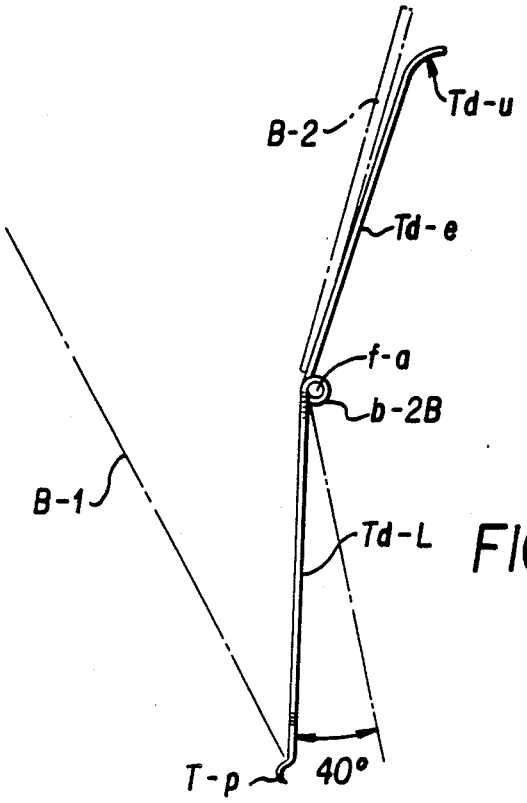

As mentioned above, and shown, for instance, in FIGS. 7, 7A, 7B, 7D, bin plate B-2 terminates well short of convergence with opposing plate B-1, this gap being bridged by the trap door plate Td, which is normally "closed" into convergent abutment with wall B-1. But, during a "dump" sequence, door Td is selectively thrust-away from B-1 (indicated in phantom in FIG. 7), at least sufficient to release the maximum contents that bin B might contain. FIGS. 7A, 7B and 7D show door Td in front, side and perspective schematic views respectively, while FIGS. 7C, 7D show, very schematically, a solenoid arrangement SOL-A for rotating axle f-a to which the door Td is affixed.

More particularly, door Td comprises a relatively rectangular plate Td-L nearly as wide as bin B (e.g., about 3" by 2") and having an array of curved-tip prongs t-p regularly spaced along its lower edge for reception into conforming slots along the lower edge of plate B-1. Door plate Td-L is preferably made of relatively light, resilient material (e.g., 15 mil beryllium copper with non-reflective black matte finish) and preferably includes a pair of upwardly projecting legs Td-e (i.e., return-spring extensions). Plate Td-L is rigidly, non-rotatably affixed to shaft f-a (e.g., preferably welded along roll-portion as indicated) to be rotated therewith and is fixed in position (as indicated, for instance, in FIG. 7B) so that the legs Td-e are thrown into firm spring-contact with the back wall B-2, B-3 of the bin B (preferably a slight radius is placed on the distal end of each leg Td-e to facilitate this spring contact). Legs Td-e should be long and narrow, lightweight, yet stable and resilient, offering minimum mass for the solenoid actuator to drive.

Lower edge Td-LL of door plate Td-L is provided with an array of like, curved-tip "detents" or prongs t-p adapted to be seated in conforming notches of plate B-1 and bar exit of a ticket, etc. when a slight, "accidental" gap between Td and B-1 might exist. The upper ends Td-L of legs Td-e (FIG. 7B) are curved away from plate B-2 so as to avoid scraping contact.

Figure 7C:
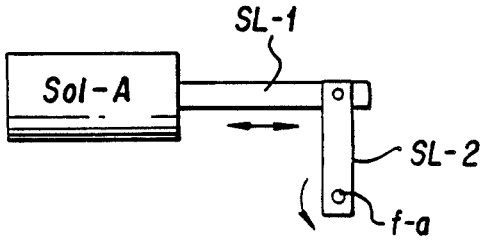
Figure 7D:
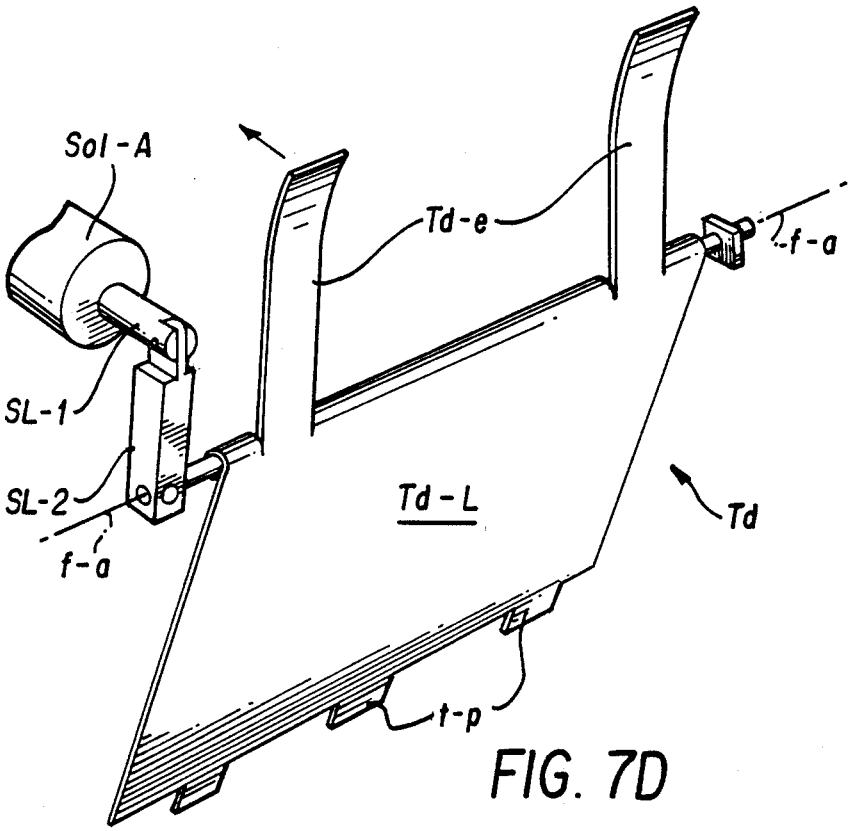

As indicated, somewhat schematically, in FIGS. 7C, 7D a solenoid SOL-A (or like selectively-operable linear actuator means) is mounted on bin B, being coupled to rotate axle f-a, and, with it, door Td on a "dump command". This is automatically invoked by machine controls after occurrence of certain "error conditions", like erroneous or incomplete printing as mentioned. It is also automatically invoked if a customer fails to remove (all of) his tickets from bin B. Thus, machine AT is preferably fitted with a suitable ticket detector on bin B, and following a suitable delay (e.g., two minutes) after opening-up the port (e.g., allows for customer also forgetting to relock the window pw), or after locking window pw—given the detection, then, of tickets left in bin B (one or more).

Figure 9B:
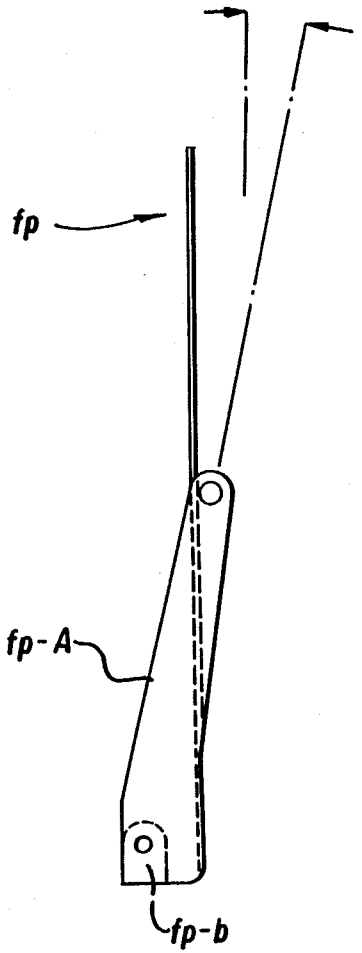
Figure 9A:
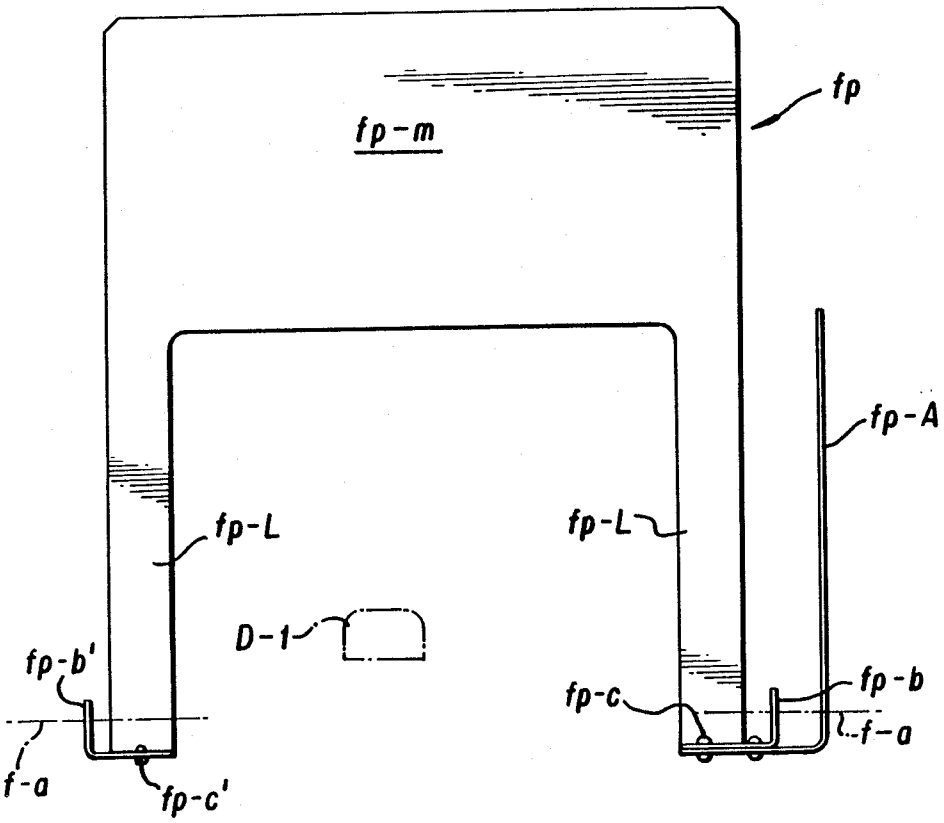

For this purpose, we preferably provide a ticket-detector D-1 on bin B (on back-wall B-2 thereof, see FIGS. 6, 7, 7A, 9A disposed between legs Td-e, FIG. 7A, and between legs fp-L, FIG. 9A). Detector D-1 may comprise an IR cell, or the like, of known construction adapted to project a radiation beam toward opposing bin wall B-1 whose associated inner surface may be treated (black, matte) to make it "low reflectivity", while tickets TK are relatively "light" and exhibit high reflectivity. Unit D-1 also senses the so-reflected beam and applies a detect-signal output (S-3, FIG. 11) as known in the art, to machine controls, indicating "tickets-in-bin". Thus, when at least one ticket TK intercepts the detect-beam the associated photo-sensor output will be driven "high" (S-3) to present a "bin-not-empty" signal to machine AT, triggering a "dump" command.

FIGS. 7, 7C illustrate an appropriate linkage for this dumping of Td (see solenoid arm SL-1 adapted to be actuated linearly, as per the arrow) by SOL-A. Arm SL-1 is rotatably coupled to an extension arm SL-2 which is firmly affixed to (a flat on) shaft f-a—to rotate f-a upon actuation of solenoid SOL-A as known in the art. This actuation-excursion will result in sufficient opening of the "trap door" to allow maximum-width contents to be dumped from bin B down into receiving pocket RP as understood from the prior discussion—e.g., for the projected maximum bin-load here (up to nine tickets TK), it is found that an excursion of about 10° for the lower edge TD-LL of plate TD-L is satisfactory, giving an opening on the order of 0.38" (the ticket stock is about 7 mils thick so a full load of nine cards would present a thickness of about 0.063, if the pack were nicely compressed).

"Bunching"

According to another feature hereof, the tickets or like contents in bin B may be automatically pressed together resiliently and "bunched" for better, more aesthetic and effective presentation to the customer, this preferably being done automatically in conjunction with the manual rotation of bin B described above. Surprisingly, we found that without such "pack-compression" means, the perforate tickets TK tend to stack in unruly fashion and are difficult to grasp, with a "fanning-out" effect thrusting tickets against the bin plates at times. This pack-pressing means also presents a neat package to the customer, one that is attractively "bound". This action is preferably implemented by a window-coupling arrangement (see FIG. 9C), whereby rotation of bin B from the "receiving" position (FIG. 7) to the "access position" (FIG. 8) will automatically rotate resilient press plate fp from "open position" (FIGS. 7, 9C) to "thrust position" (FIG. 8).

Figure 9C:
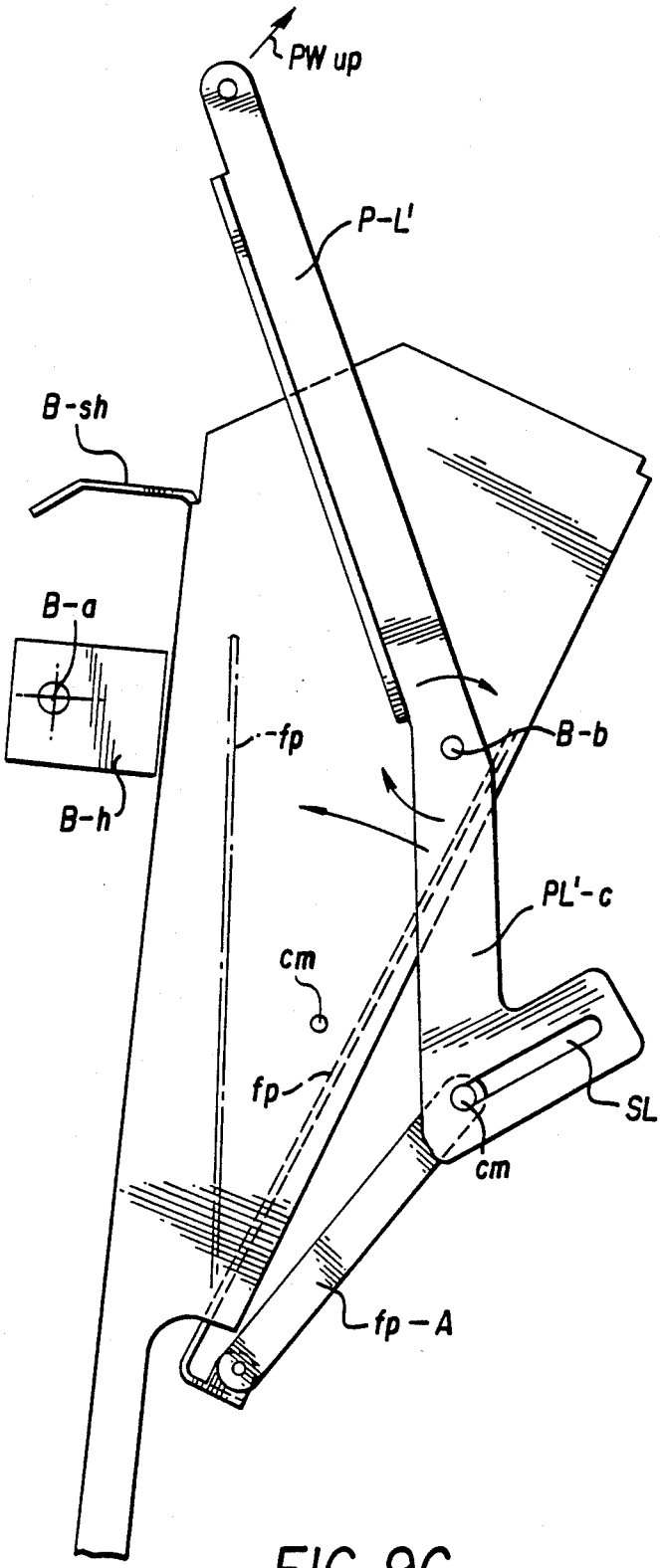
FIG. 9C is a like view of a cam-follower linkage therefor.

This may be effected in various ways. One preferred method is to mount plate fp rotatably on an axle coupled to window PW via a cam-follower arrangement to so rotate the plate fp in conjunction with raising of window PW. Such an arrangement is shown in FIGS. 7–9 wherein press-plate fp will be understood as rotatably attached to axle f-a (on which the trap door Td is fixedly mounted as noted above) with the cam-follower arrangement coupled to rotate plate fp as bin B is rotated, rotating it sufficient to drive plate fp from the "open" to the "thrust" position as indicated in FIGS. 7 and 8. FIG. 9C is a schematic side view, along the lines of FIG. 7, ut on the opposite side of bin B with the cam-follower and associated arm fp-A, etc. shown (perspective reversed for drafting convenience; the opposite side B-S' of bin B is really involved, as workers will appreciate—note, vs. FIG. 7 counter-weight arm, etc. are removed for clarity of illustration). Here, an arm P-L (connecting window PW and the end of a counter-weight arm at B-h) is extended to form a follower-extension PL-C with a cam-slot SL of prescribed size and conformation, so as to receive an associated cam projection cm on the end of arm fp-A. Thus, as window PW is raised (arrow pw) and arm PL rotated about pin B-b (arrows), follower-extension PL-C and slot SL are rotated toward bin B, driving cam cm with them to end up at a prescribed point (cm' in phantom, corresponding to the thrust-forward position for press plate fp shown in phantom—cam cm thrusting its arm fp-A, and plate fp thusly).

Press-plate

Thus, bin B preferably also includes an automatically-actuated resilient press-plate fp adapted to be thrust against the ticket-load in the bin, compressing the tickets together when the bin and its ticket-load are presented to the customer. FIGS. 9A and 9B indibate a preferred form of plate fp in front and side view respectively. Preferably the plate assembly includes an upper, relatively rectangular plate fp-m for thrusting the upper part of tickets TK, being almost as wide as bin B and about one-half its height (e.g., about 4" wide by about 2" high here), with a pair of narrow side legs fp-L projected downwardly therefrom for rotatable attachment on axle f-a. For this, each leg fp-L terminates in a respective orthogonal extension fp-e which is projected outboard of the plate to, itself, terminate in an orthogonal up-projected bracket member fp-b, fp-b' respectively. Brackets fp-b, fp-b' are apertured and arranged to be rotatably mounted on axle f-a (see also phantom view in FIG. 7A discussed above).

Plate fp-m is cut-out to admit the detect beam from D-1 and to leave flanking legs fp-L so as to minimize its weight as well as to enhance its resiliency when pressed against the upper portion of the pack of tickets (as workers in the art will understand, e.g., about 2½" long by about ¼ to ⅜" wide, the entire plate may be made of beryllium copper stock about ¼" thick or like light, durable material).

In addition, an actuator arm fp-A is rigidly affixed on one extended portion fp-e from a leg fp-L, fp-A being attached to fp-e via an orthogonal bracket portion fp-AA thereof (e.g., see screw fittings schematically indicated in FIG. 9A) for coupling plate fp to window PW. As explained elsewhere, this relatively elongate arm fp-A is adapted to carry cam pin cm at its distal end and so be coupled, in slot SL, in cam-follower fashion to linkage with the window PW. Thus, as the window is, for instance, raised, the arm fp-A will be gradually rotated to throw press plate fp-m outwardly, toward port P (as bin B is rotated), terminating in the "full-compression" position for plate fp indicated in FIG. 8—being firmly, but resiliently, thrust against the top of the pack of tickets stacked in bin B.

For this purpose, plate fp extends across most, or all, of the width of bin B so as to thrust the upper part of the contents thereof forward, toward the customer (upper portion of the tickets). Preferably this thrust and the resilience of legs fp-L are such that its upper portion fp-m will be resiliently driven against the ticket contents, so that it can "bunch" as few as two tickets TK and as many as nine in position to be accessed neatly by the customer through port P.

Advantaqes of bin

On first look, a "stack holding means" like bin B might seem unnecessary, workers preferring to directly advance tickets from the printer(s) to the customer. But, as mentioned above, considerations of what to do with "error-tickets" or with a partly-executed set of tickets or "forgotten" tickets, etc. makes some sort of "collecting means" advantageous. Also, where a worker might prefer to collect tickets in a simple "fixed box" under a machine-opened window, such becomes problematic on considering how difficult it is to advance perforated tickets reliably. For instance, one might consider a "chute" connecting a printer out-slot to such a "fixed box", with the tickets sliding between; but, as those experienced in handling perforate documents know, one may expect the often-semi-folded tickets to get "hung-up" all too often. Also, when the machine has the space constraints of machine AT, any such "hold-box" cannot be too close to the machine front, yet cannot be very far from the printer(s), lest ticket reception be complicated.

A related consideration is ticket delivery to the bin B. One might expect it possible to merely position the bin below the printer eject-slot to assure reliable gravity-delivery (e.g., with a guide means possibly). However, we find that such cannot give reliable delivery, particularly for semi-folded perforated documents which are often delivered to the bin with a segment bent one-way, the succeeding ticket bent the opposite, etc.—e.g., preventing some tickets from being fully-inserted into a bin. Also, we find that a ticket printer-separator like TP (fan-fold stack) is all too apt to eject one ticket "skewed to port", the next "to starboard", etc.

Figure 2:
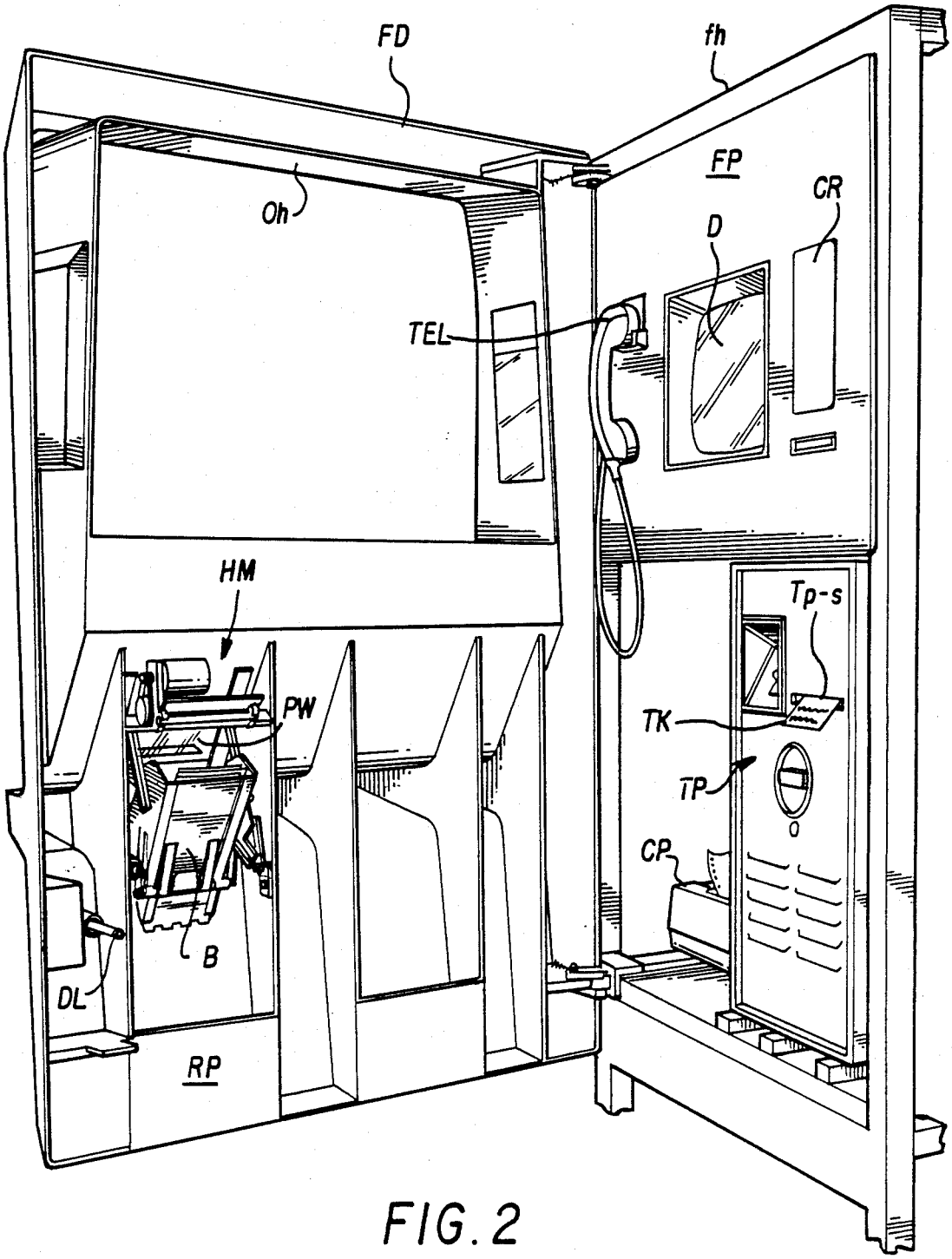
FIG. 2 is a like view with the front door FD thereof swung-open.
Figure 2A:
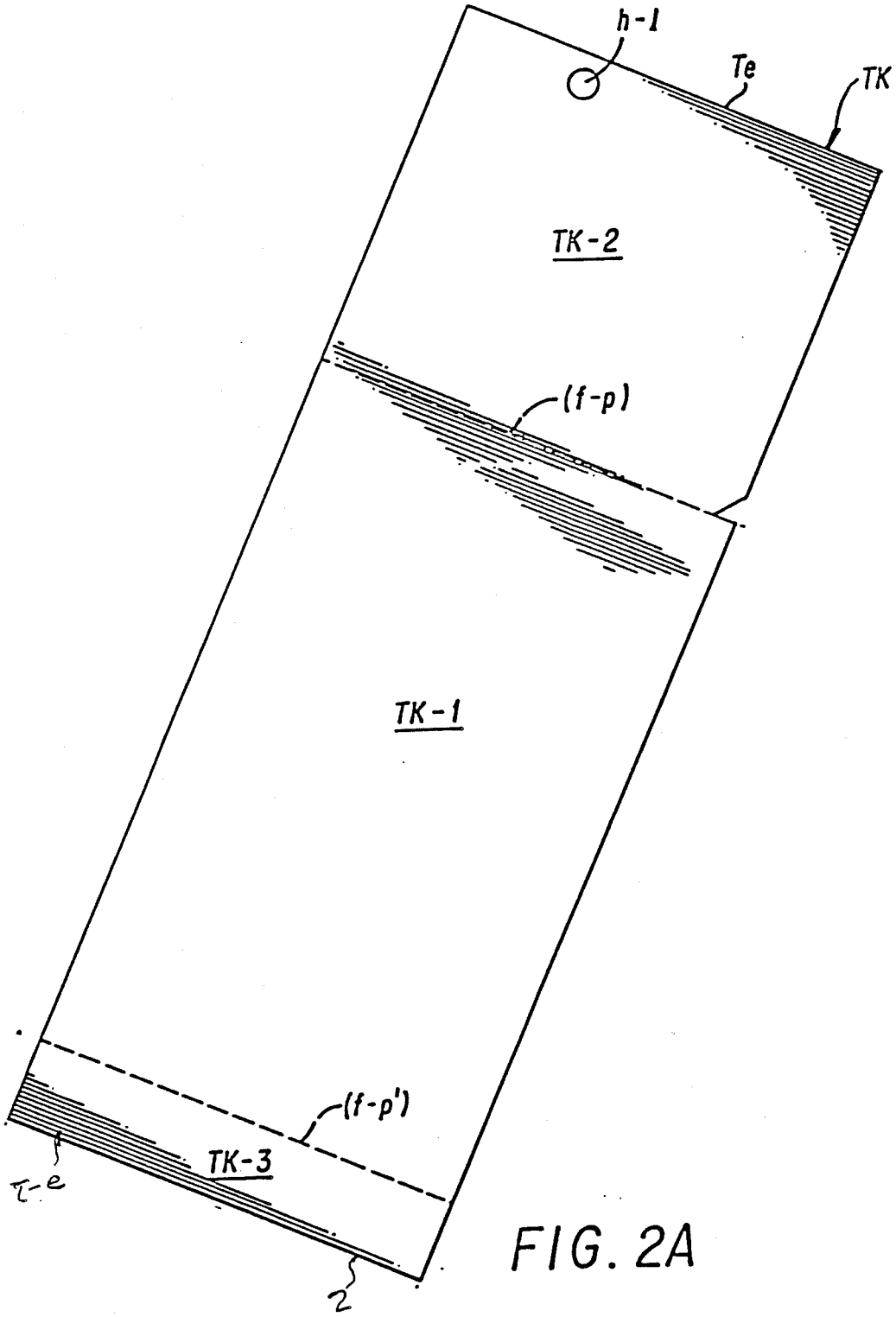
FIG. 2A shows an associated sample perforated ticket.
Figure 10:
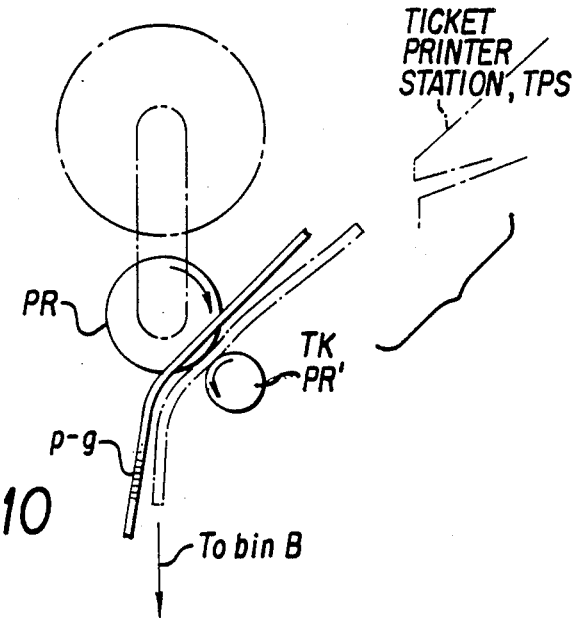
FIG. 10 is a schematic side sectional view of the pinch rolls PR, PR' along with associated guides shown in schematic operating relation with a sample segment of a ticket TK.

Thus, we find it advisable to introduce pinch-roll advance means between printer and bin. Such is indicated in FIGS. 2, 4, 6 and particularly FIG. 10. Thus, workers will perceive a pair of pinch rolls PR, PR', one (PR) being selectably driven by suitable means (see motor PM, under machine control, and pulleys with belt linkage as known in the art), the other idling. Preferably, the nip between rollers PR, PR' is positioned quite close to the printer eject slot (TP-S, FIG. 10; well under a ticket-length) and a deflector guide P-g is preferably provided to guide tickets being ejected into the nip. Guide P-g is also bent along its length to divert tickets, being advanced by the rolls, downward to the mouth of bin B. A guide P-g' may also be disposed to guard against tickets being thrust into roll PR' (e.g., tickets may "free-fall" only about ½"–1" or less).

Bin B will be disposed, and dimensioned, so that tickets will be advanced almost full-into the bin by rolls PR, PR' (a second set can be provided as dictated by spacing), lest the "fanning-out" of the perforate tickets cause them to hang-up and stop short of full entry.

Control system for ticket vending machine AT

Figure 11:
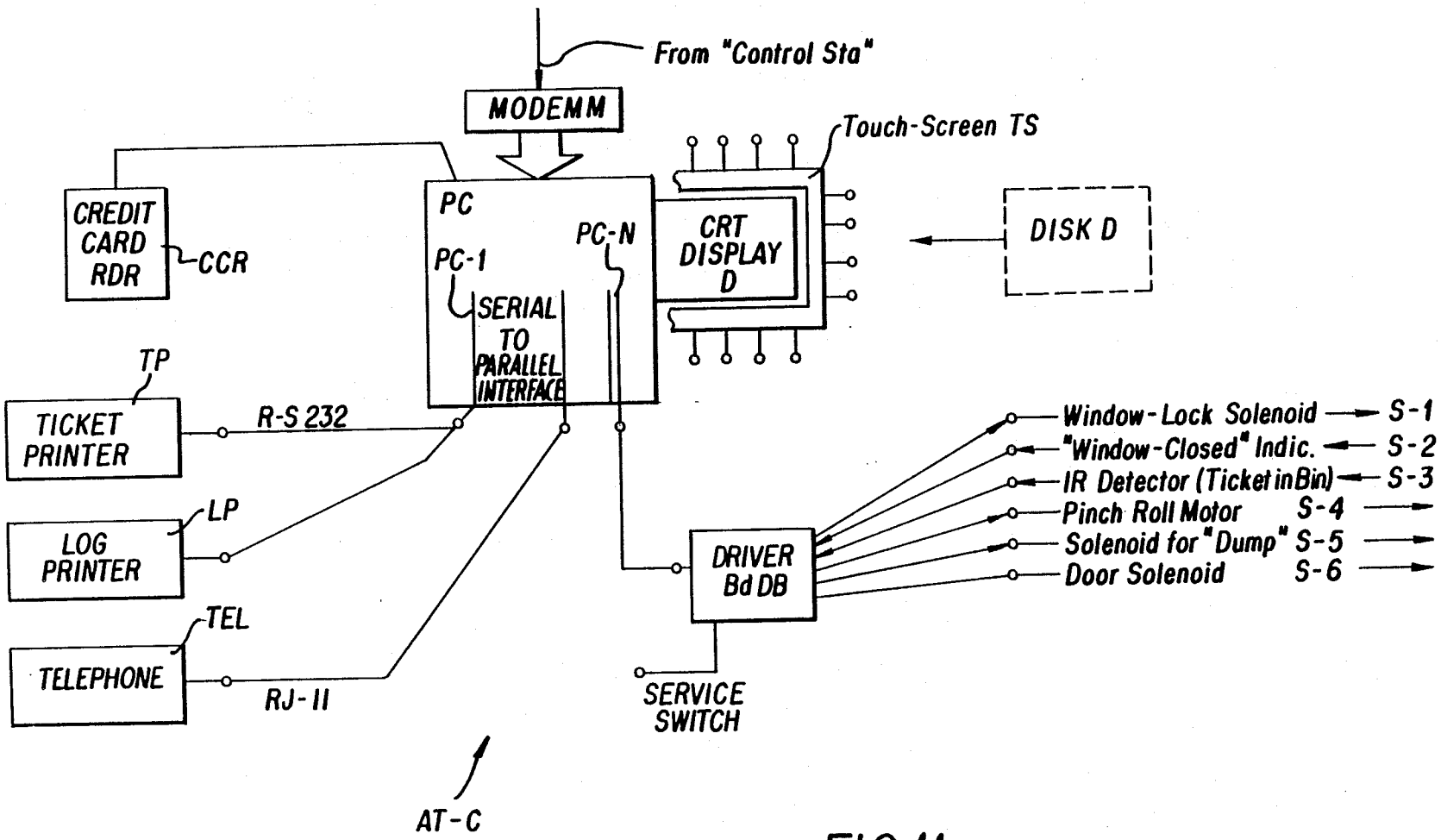
FIG. 11 is a schematic diagram of functional elements of machine AT shown operatively associated with the data processor PC therefor and related signals.
Figure 13A:
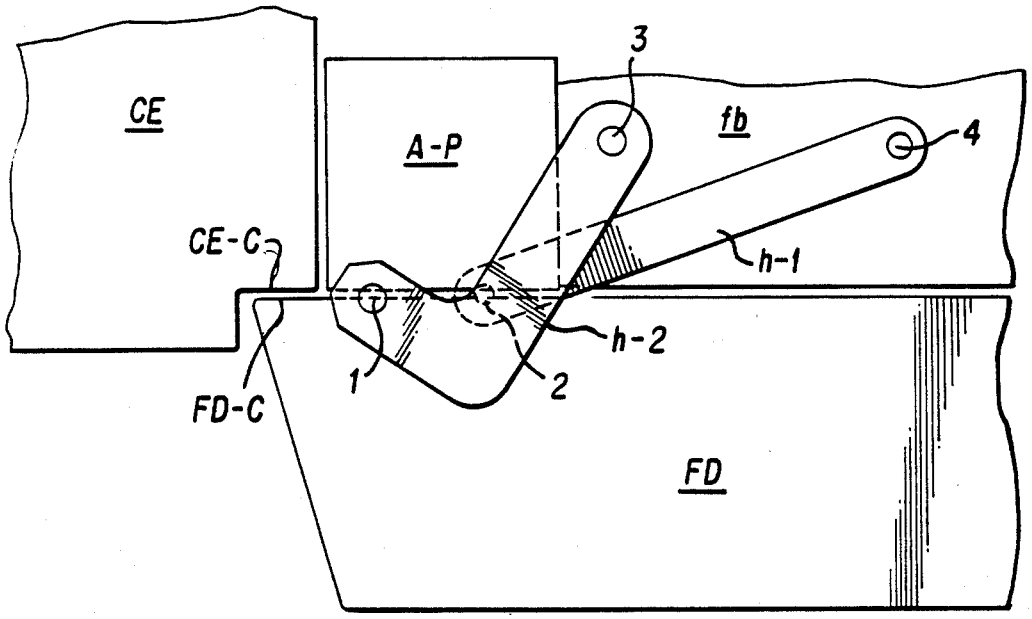
Figure 13B:
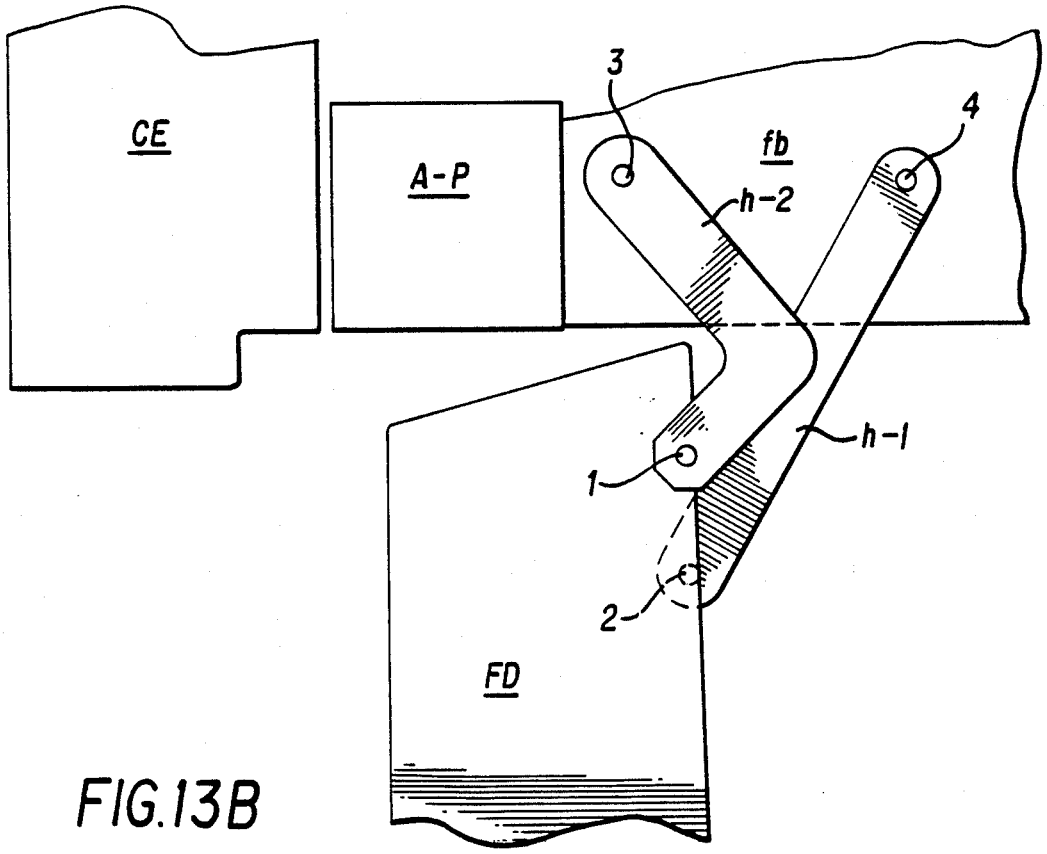

The aforedescribed ticket vending machine AT, and particularly ticket handling mechanisms HM therefor, may, of course, cooperate with various related other machine components including an appropriate control system. FIG. 11 shows a preferred control arrangement AT-C focused around a data processor control means PC (e.g., an "AT" PC microcomputer by Sperry Co. of Blue Bell, Pa., now Unisys Corp.). Various features thereof are described as follows.

As mentioned before, a telephone unit TEL is provided linking the customer, computer PC and the machine system to a control station, a message center or the like, as known in the art (e.g., a customer having difficulty with the machine, needing instruction or special advice, etc. may simply pick up the receiver and be automatically connected to an information source). Also, a service person may use the telephone for maintenance purposes. Similarly, the telephone line may be used , via an appropriate modem, to receive appropriate signals from a central computer CPU at a central control station as known in the art, e.g., using a central data base to update or otherwise modify the PC memory from time to time, or remotely load software, for instance re airline schedules, price changes and the like.

CRT display screen D is appropriately connected to computer PC and controlled thereby to provide a visual display for communicating with the customer. Feedback from the customer may be provided in various appropriate ways, e.g., from a keyboard (not shown here) and/or with a touch screen TS surrounding display D. Touch screen TS is schematically, and partially, indicated in FIG. 11 and operates as known in the ar with opposed pairs of radiation source/detector means arrayed completely about the display screen D. As an option, a disk drive D, or other digital storage means (e.g., video disk), may be provided to be coupled to display D for showing promotional messages such as advertisements, cartoons, directions on use of AT and the like, displayed on screen D between periods of customer use.

A driver board DB is coupled for operative communication with computer PC and accommodates various signals as indicated in FIG. 11; for instance, signal S-2 from a "window closed" indicator (e.g., the mentioned microswitch ms mounted beneath window PW to be actuated upon bottoming and closing of the window); such as a window-locking solenoid signal S-1 which may be outputted from computer PC to cause locking of window PW by actuating solenoid SOL-P (see FIG. 7), this signal being issued upon receipt, for instance, of the closure signal S-2 mentioned above; such as a "dump" signal S-5 inputted to the solenoid SOL-A for opening the trap door Td and dumping the contents of bin B as mentioned above; such as signal S-4 to activate pinch roll motor PR-M and rotate the pinch roll described above, doing this when advancing the first ticket from printer to bin upon receipt of indication that the ticket has been printed and is being ejected from ticket printer TP (motor PR-M kept "ON" until the last ticket in a set is so ejected); and such as a "ticket-in-bin" signal S-3 provided from the IR detector D-1 (e.g., FIG. 7) operating to indicate the presence in bin B of one or more tickets.

As mentioned, at least one ticket printer TP is also provided and connected for appropriate control, with input/output signals to/from computer PC (e.g., one preferred ticket printer is the "Blue Max" by DSI Co.). Similarly, a log printer LP is preferably provided and connected to be controlled by computer PC, this printer generating a chronology of events such as the name and other identification of each accessing customer, his credit information, the itinerary he requests, indicia of the tickets printed and issued to him, and also an indication as to whether any such tickets were "dumped" into receiving pocket RP, etc., whether the customer signalled that he withdrew all his tickets and that they were satisfactory, etc. Such a log may, of course, be usefully kept with machine AT to check on transactions conducted. It may also serve as a double check on similar signals provided to a remote control station. Also, service personnel may inspect the log to discover, or verify, malfunction conditions, to verify the contents of pocket RP, etc., as known in the art. Further, where desired, a copy of this log may also be presented to the customer (this option is not indicated in this embodiment however).

Also connected to computer PC is a credit card reader CR of known type and adapted to receive an appropriate credit card and, detecting information thereon, stimulate a check (e.g., by computer PC or the remote CPU) of the status of the customer's credit. Thereupon machine AT can automatically debit his account for any purchases made, etc., as known in the art. For instance, suitable operation with such an embodiment was experienced using a "SANAC" card reader by Sankyo, Seiki Mfg. Co. Ltd. of Tokyo, Japan.

Results

The foregoing ticket vending system and associated machine mechanisms described have many advantages, some unexpected as workers in the art will perceive. For instance, such a machine is uniquely apt for handling perforated tickets despite the bending, distorting or ripping at the perforations that they commonly exhibit. The system insures security of valuable tickets by barring customer-access until printing is completed and by discarding incomplete, erroneous or forgotten tickets.

Thus, following-up on the "typical operation" mentioned above, the following operational steps are noted.

Phase 1: pre-printing

It is assumed that the customer has satisfied the preliminaries (e.g., credit card accepted) and that he has indicated this (e.g., via touch-screen) to machine AT without any problems (e.g., machine AT can call for his decision to have tickets issued and billed, e.g., via the screen message: "If selection is complete, please touch "PRINT" below"). It is also assumed that machine AT is conditioned to accept this (e.g., window PW is closed, locked, etc.; if not, an appropriate screen-direction will call for curing, or signal inoperativeness to both the customer and a remote control means.

Phase 2: Printing, etc

Machine AT is now assumed ready to "print" [print signals approved and applied to TP, LP and, via MODEM, to remote "control station"; ticket-stock available, etc.—else an "ERROR" condition arises, and the customer is so advised—cf. on screen]; so printing commences, e.g., each ticket in this set is advanced, severed, printed, ejected to bin B. The while, a message [e.g., "Tickets Being Prepared"] may be given to the waiting customer. Initial ticket ejection can be made to activate pinch roll PR (motor PR-M) long enough to advance all tickets into bin B.

If, in the course of this, any error-condition arises (e.g., run out of paper stock or machine detects that print-signals are not "valid"), the customer may be so advised (e.g., "ERROR" on screen) and the possibly-faulty tickets can be "dumped" (to pocket RP) rather than issued to the customer. Workers will much appreciate this feature of advantage whereby bin B serves as a "holding-station", secure within the machine, whereby bin contents are not dispensed until, and unless, printing and other processing operations are completed as planned.

And other supplemental advantages can accrue. For instance, detect means in bin B can signal whether the predetermined number of tickets have arrived (e.g., none been pushed aside by TP or PR, etc.), whether they are appropriately aligned (e.g., none tilted askew, and so forth)—and "DUMP" all into pocket RP if all preconditions are not satisfied.

Phase 3: Dispensing

Assuming that all tickets are correctly printed, handled and arrive in bin B (i.e., no "DUMP"), they are ready for dispensing. Now, window PW may be unlocked (SOL-P withdraws lock-pin) and the customer may be directed to open window PW [e.g., "Lift Window and Remove Tickets" on screen], His lifting of window PW will, as described above, "open" switch ms and automatically pivot bin B toward its "dispensing condition" (FIG. 8), while simultaneously thrusting pressure plate fp against the tickets to "bunch" them for easy removal. It may be noted that where window PW is "transparent" as here, the customer may perceive that his tickets are in bin B. As noted, we preferably provide a shield means B-sh projected from bin B to shield the rest of the bin and associated mechanisms from view, thus presenting a clean (e.g., black, non-reflective) appearance, while also shielding machine inwards from the view of would-be vandals.

Holding window PW open with one hand, the customer reaches into bin B and removes (all) his tickets with the other hand; then he releases window PW which proceeds to slowly drop into "fully-closed" position, returning bin B and plate fp to "receiving" position (FIG. 7). The "closed" condition of window PW closes microswitch ms which signals this to machine AT. If ticket-detector D-1 indicates that "No Ticket" is left in bin B, machine AT is recycled out of this transaction [e.g., on screen: "HAVE A NICE TRIP"] and into the next, automatically locking PW—i.e., to a RESTART mode, ready for the next ticket-ordering/dispensing sequence; otherwise not.

If, for some reason, window PW was not fully closed, machine AT will note this after an appropriate delay, and direct the customer to close it (e.g., on screen, buzzer alarm., etc.).

If all tickets are not removed from bin B after an appropriate delay (e.g., one minute of detector D-1), machine AT will preferably so notify the customer (e.g., on screen, buzzer alarm, etc.).

If, despite the foregoing, one or more tickets remains in bin B, machine AT will (e.g., after further delay) automatically "DUMP" bin B in pocket RP (assume they were forgotten; avoid risk of unauthorized withdrawal later) and lock window PW if this was not already done (and PW is "closed").

Summarizing, the machine cycle is complete, and RESTART invoked, where:

window PW is closed, and is then machine-locked after:

A—either all tickets removed (D-1 detects), within time $d_1$ (courtesy delay).

or B—or tickets left in bin after "courtesy delay" $d_1$ (also automatic "dump").

[Note: if bin was "dumped" early, window PW is never unlocked!].

Therefore, once window PW is unlocked (SOL-P), machine AT can start timing means to count-down "courtesy delay" $d_1$, then either removal of all tickets (D-1) plus closing PW cause AT to lock window PW (SOL-P), or expiration of delay $d_1$ plus closing of PW cause AT to lock PW [in the latter case, customer may be directed to quickly remove tickets after part of $d_1$ has elapsed]. And, the foregoing assumes that, if PW was opened at all (ms), it was fully-closed within delay time $d_1$—and if not so closed within time $d_1$, alarm means, etc. plus a screen message will urge that PW be closed, after which machine AT will immediately lock it.

Concrete enclosure

Figure 1:
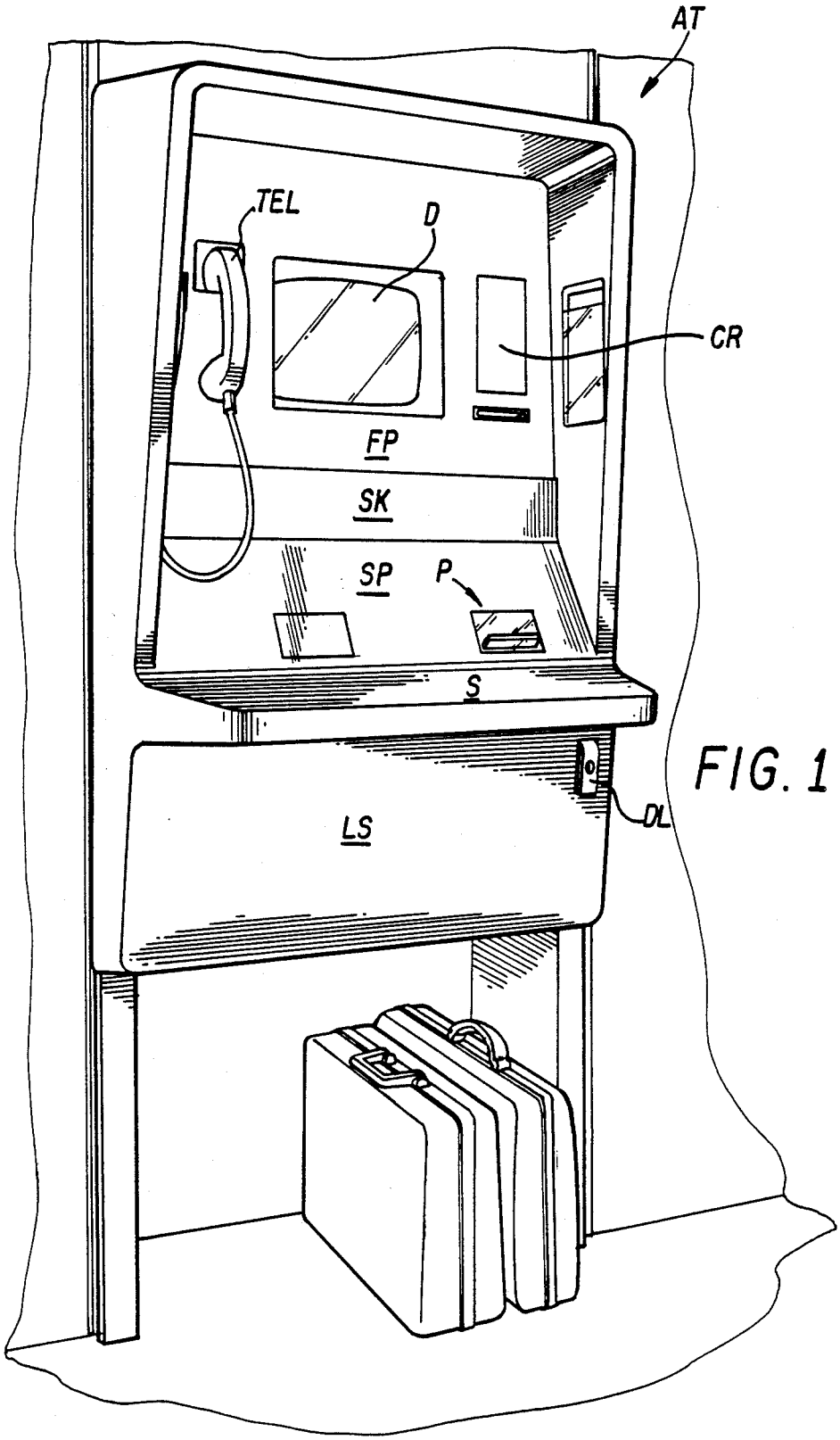
Figure 12:
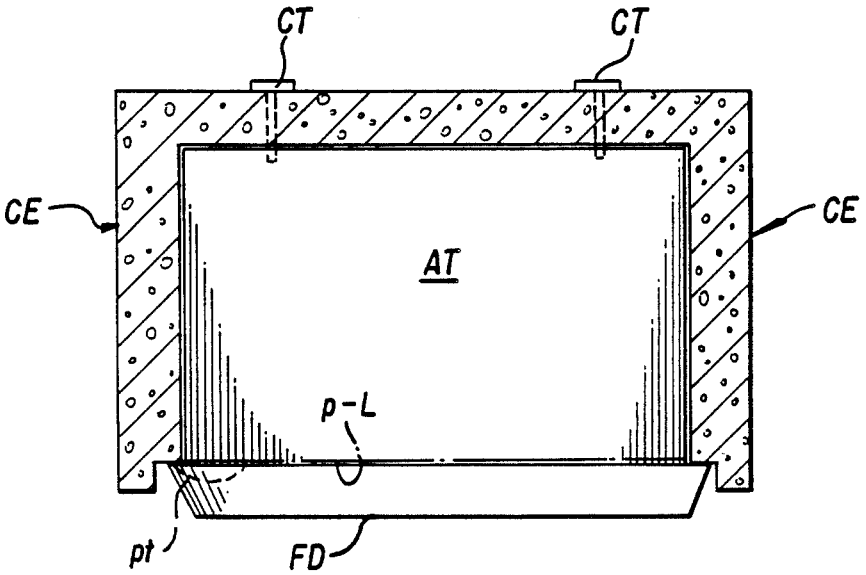
FIG. 12 is a schematic plan view of machine AT (in phantom except for front door) with concrete enclosure.

FIG. 12 shows, in schematic plan view, a modified embodiment wherein machine AT (or the like) is partly enclosed by protective enclosure means CE. Preferably, this comprises a three-sided concrete-fiberglass composite wall, slightly higher than machine AT and sufficiently thick (e.g., 2–3") and strong to resist forced entry into machine AT, especially when the machine is "free-standing" (i.e., not inset into a wall cavity as in FIG. 1 for instance). Door FD "closes" shell CE along a "plane-of-closure" P-C. Securing means is also provided across the top of enclosure CE (e.g., a steel plate, perforated to pass ambient air—this not shown). Enclosure CE should be anchored in place, e.g., via anchor-bolts in the site floor (not shown), etc. Machine AT should be secured to CE, e.g., via connector bolts CF.

Figure 3:
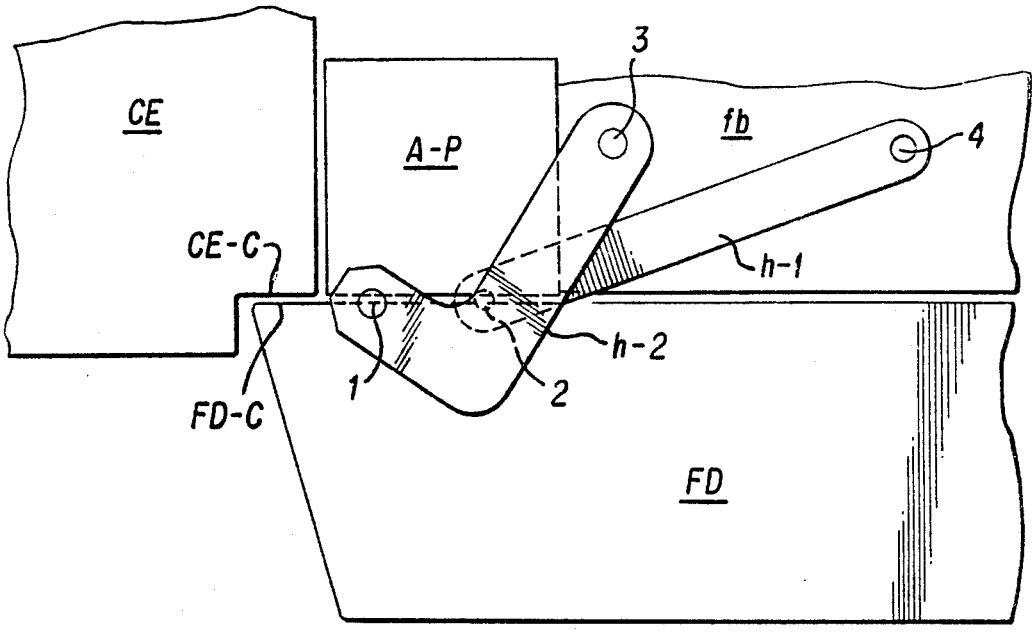
FIG. 3, FIG. 5 are enlarged plan views of the hinge means for the front door, in "closed" and "open" condition, respectively.

Enclosure CE is also preferably relieved at the front corners confronting front door FD (see CE-C, FIG. 3) so as to allow the door edges to be inset into CE sufficient to "shield" machine AT and bar access to any part thereof, especially barring access to the door hinges when door FD is "closed" (as in FIG. 3); note corner CE-C relieved to receive the door corner and bar access by vandals, etc. to corner post A-P (see FIG. 2 also) or to hinges h-1, h-2.

Hinges

Figure 5:
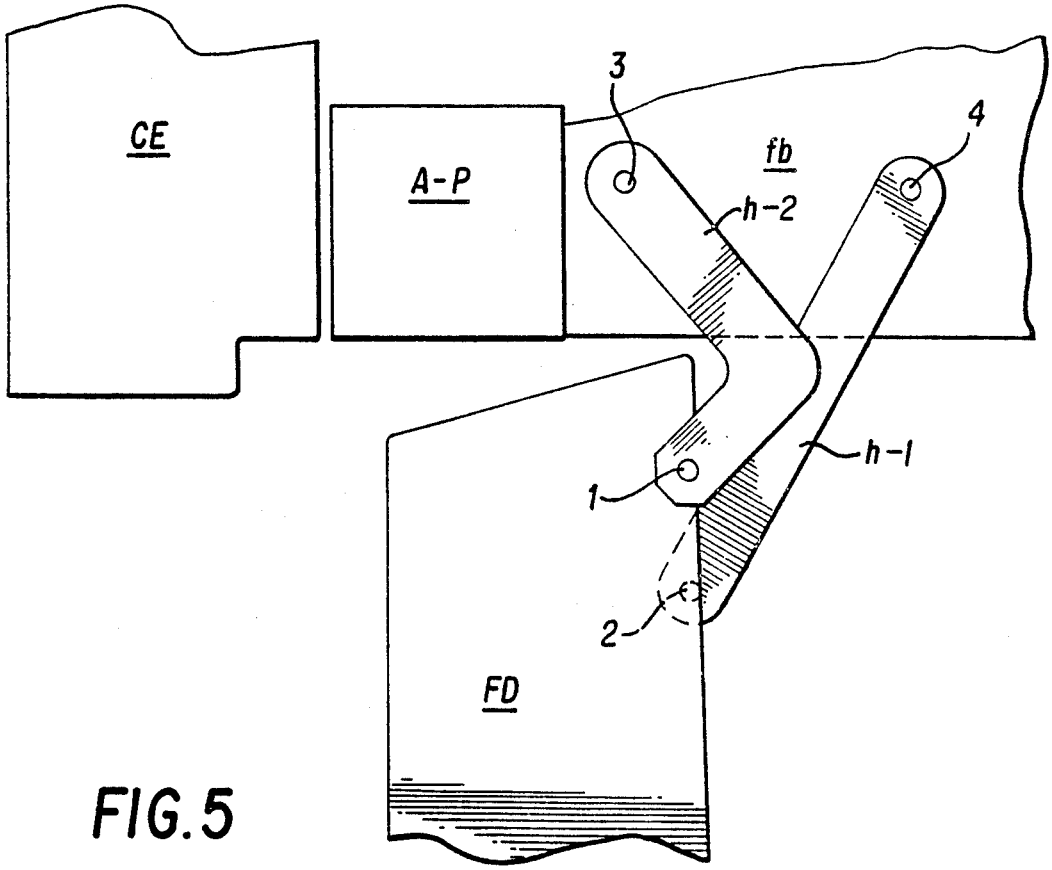

In a related feature, with the hinged sides of door FD so closely inter-fit with enclosure CE, it will be apparent that special hinges must be provided—since ordinary single-post pivot hinges, "piano-hinges" or the like, would allow the corner FD-C of door FD to impact (pivot-in against) corner CE-C during opening. Thus, according to this feature, we provide "translation-hinge" means h-1, h-2 that allows this corner FD-C to be translated somewhat linearly, yet arcuately relatively along the "plane of closure" P-C (FIG. 12) when door FD is opened—see path pt undergone by door corner FD-C in going from "closed" condition (FIG. 3) to "open" condition (FIG. 5).

A preferred "translation-hinge" means comprises a first, rectilinear hinge-plate h-1 connecting a hinge post 2 journaled in door FD to a hinge post 4 journaled in machine AT (on bar fb) plus a second super-posed, L-shaped hinge plate h-2 connecting a hinge-post (pin 1) journaled in door FD to a hinge post 3 journaled in machine AT (bar fb), all posts being journaled in their respective plate to accommodate rotation thereof, as understood in the art. Thus, it will be noted that swinging door FD "open" acts to swing post 1 arcuately about post 3 and post 2 arcuately about post 4. The "dog-leg" in hinge plate h-2 allows it to "clear" the corner FD-C of the swinging door, and keeps the corner from pivoting-in against machine AT.

Conclusion

Though machine AT is described exemplarily in terms of vending airline tickets, workers will perceive that it may readily be adapted to other uses; such as vending bus and/or railroad tickets, tickets for entertainment events, reservations (e.g., hotel, rental car), such as on-site vending of articles or remote ordering of merchandise (e.g., displayed on screen D), etc. And handling means like bin B may evidently be adapted to receive and "hold" a variety of items secured within an enclosure, to be made available for outside-access only upon satisfaction of prescribed conditions. When such items comprise tickets, cards or like unit records, or other flat items, it will be apparent that item-bunching means like press-plate fp will be of added advantage.

It will be understood that the preferred embodiments described herein are only exemplary, and that the invention is capable of many modifications and variations in construction, arrangement and use without departing from the spirit of the invention.

Further modifications of the invention are also possible. For example, the means and methods disclosed herein are also applicable to other article dispensing systems and the like. Also the present invention is applicable for providing record-handling as required in other mechanisms and systems, such as those in which a record is cut, imprinted and folded automatically.

The above examples of possible variations of the present invention are merely illustrative. Accordingly, the present invention is to be considered as including all possible modifications and variations coming within the scope of the invention as defined by the appended claims.

What is claimed is:

1. An automatic ticket vending machine comprising:
display means adapted to present human-readable messages to a customer;
one or more ticket printing means arranged and adapted to automatically inscribe ticket-validating indicia on prescribed unit tickets and present these to a printer-output station in response to "ticket order signals" t-o;
customer input means arranged and adapted to supply "select signals" SS indicating events to be ticketed, said input means including customer select means and valid billing indicating means;
automatic data processing means DP adapted to receive and store said select signals SS and to process them and responsively issue said ticket-order signals t-o along with associated display messages to said display means, whereby the customer may see, and verify, the associated print commands and ticketed events, price, etc.;
selectably-accessible port means including closure means adapted to be manually translated by a customer upon machine command to allow access to a prescribed ticket-removal station within the machine;
"discarded-ticket" storage means;
ticket receiving pocket means linked to said closure means and disposed operatively adjacent said printer output station(s) and adapted to receive printed tickets there from said respective printer means and to transport these to said ticket-removal station; said ticket receiving means also being selectively operable to "dump" its contents into said "discard-ticket" storage means; said translating of the port closure means being arranged and adapted to so transport said pocket means and present the tickets said pocket means and present the tickets at the ticket-removal station.

2. The machine as recited in claim 1, wherein said ticket receiving means TR comprises a receptacle adapted to be automatically shifted on machine command from "ticket receiving" condition to "ticket removal" condition whereat access can be had from said "ticket removal" station, receiving means TR being arranged and manipulated so that its ticket contents may be removed by the customer at the "ticket removal" station upon machine command.

3. The combination as recited in claim 2, wherein said port means includes transparent closure means adapted to be manually operated by the customer, upon machine command, to "open" the machine and give him access to said "ticket removal" station and the contents, of said ticket receiving receptacle TR, TR being mechanically linked to said closure means so that customer translation of the closure means will automatically effect said shift of said receptacle to be operatively adjacent said ticket removal station with its contents accessible to the customer, while also compressing said contents to create a compact package.

4. The combination as recited in claim 2, wherein said receptacle comprises a bin with an open top arranged and disposed to be pivoted by operation of said closure means from a relatively vertical ticket-receiving condition toward said port closure means and said ticket removal station.

5. The combination as recited in claim 2, wherein said ticket receiving receptacle includes automatic ticket compression means adapted and arranged to resiliently and gradually compress the ticket contents in said receptacle into a neat pack as the receptacle is shifted, being automatically actuable into, and out of, this compression mode via mechanical linkage to said closure means.

6. A machine for automatically preparing and dispensing unit records to a subject person and including:
record preparation means adapted to prepare one or several unit records in a set responsive to prescribed preparation commands and to further eject the records serially to a preparation-output station; said machine being secured against unauthorized access and arranged to allow operator access by opening of a closure means over a predetermined delivery port only upon prescribed access signals; and
record receiving pocket means disposed operatively adjacent said preparation-output station and adapted to receive printed reocrds there from said preparation means and to be shifted to present these records to be accessible to the subject person from said delivery port, said record receiving means also being selectively operable to automatically "dump" its contents into associated "discard-record" storage means upon occurrence of any one of several prescribed "anomalous" conditions;
the manual operation of the closure means being arranged and adapted, via mechanical linkage, to so shift said pocket means.

7. The combination as recited in claim 6, wherein said receptacle pocket means comprises a wedge-shaped bin with an open top, the bin being arranged and disposed to be pivoted by manipulation of said closure means so the bin is shifted from a relatively vertical "record-receiving" condition toward said port closure means and said record removal station to a record-dispensing condition; and wherein said closure means comprises a slidable door linked to said receptacle bin so that manual-sliding of the door pivots the bin to present its contents for outside human access; and wherein said receptacle means also includes associated counter-weight means coupled between said bin and said door and adapted to so pivot the bin, the closure door and associated linkage requiring relatively minimal effort and involving relatively symmetrical translation forces in opening and closing the door.

8. An automatic ticket vending machine comprising:
a ticket-dispensing port means A made selectively accessible to a customer upon machine command;

display means B adapted to present human-readable messages to a customer upon machine command;

customer-select means C operable in association with said display means subject to machine command, whereby a customer may select one or more tickets to be vended;

credit indication-verification means D operable under machine command;

one or more ticket printing means E operable subject to machine command;

automatic data processing means F operably coupled to all the foregoing port means A, display means B, select means C, vertification means D and print means E in signal-receiving/signal-issuing relation therewith, whereby upon receipt of appropriate customer signals and authorized credit-indicating signals, said display means may be caused to issue successive messages to guide the customer to select one or more events at sect-means C, these to be ticketed and billed whereupon one or more of said printing means F will be activated to issue valid tickets converting the events;

said machine also including modem means connecting it to a remote control station where-from controls of said data processing means may be modified remotely; and also includes automatic ticket-delivery pocket means linked to the port means and arranged and adapted to collect and transport all in a series of tickets for a given customer from the printer means to said port means under the control of said data processing means, the opening of the port means serving to so transport the tickets for customer access.

9. The machine as recited in claim 8, wherein said port means comprises manually-operated closure means adapted to be manually operated by the customer, upon machine command, to "open" the machine and give him access to said "ticket removal" station and the contents of said ticket receiving receptacle TR, and wherein said ticket receiving receptacle is mechanically linked to said closure means os that customer translation of the closure means will automatically effect said shift of said receptacle to be operatively adjacent said ticket removal station with its contents accessible to the customer.

10. The machine as recited in claim 8, wherein access to said port is controlled by port closure means, unlocked by said data processing means and opened manually by the customer; and wherein said receiving pocket means comprises a cuneiform bin normally disposed in an upwardly-divergent, open, ticket-receiving position and adapted to be automatically pivoted toward said port for customer access via mechanical linkage with said closure means, being so-pivoted gradually as the closure means is opened by the customer.

11. The machine as recited in claim 10, wherein said bin also includes a ticket-bunching compression plate means which is mechanically linked with said closure means to be driven thereby, whereby to be automatically thrust toward the ticket contents of said bin when the closure means is opened and thrust in the opposite direction when the closure means is closed.

12. The combination as recited in claim 6, wherein the preparation means includes printing means, wherein the delivery port includes manually-translatable closure means operable under machine command; and wherein said record receiving means comprises a receptacle adapted to receive records from the printing means in a first position and to be automatically shifted to a second record-dispensing position where customer access may be had, this shift being effected via mechanical linkage with the closure means, so that translating the closure means so shifts the receptacle conjunctively therewith.

13. An automatic ticket vending machine comprising:

display means adapted to present human-readable messages to a customer;

one or more ticket printing means arranged and adapted to automatically inscribe ticket-validating indicia on prescribed unit tickets and present these to a printer-output station in response to "ticket order signals" to-o;

customer input means arranged and adapted to supply "select signals" SS indicating events to be ticketed, said input means including customer select means and valid billing indicating means;

automatic data processing means DP adapted to receive and store said select signals SS and to process them and responsively issue said ticket-order signals t-o along with associated display messages to said display means, whereby the customer may see, and vertify, the associated print commands and ticketed events, price, etc.;

selectably-accessible port means adapted to be opened by a customer upon machine command to allow access to a prescribed ticket-removable station within the machine, said port means including closure means adapted to be manually operated by the customer, upon machine command, to "open" the machine and give him access to said "ticket removal" station and the contents of said ticket receiving receptacle TR;

"discarded-ticket" storage means;

ticket receiving means disposed operatively adjacent said printer output station(s) and adapted to receive printed tickets there from said respective printer means and to transport these to said ticket-removal station; said ticket receiving means also being selectively operable to "dump" its contents into said "discard-ticket" storage means;

said ticket receiving means TR comprising a receptacle adapted to be automatically shifted on machine command from "ticket receiving" condition to "ticket removal" condition whereat access can be had from said "ticket removal" station, means TR being arranged and manipulated so that its ticket contents may be removed by the customer at the "ticket removal" station upon machine command, this ticket receiving receptacle TR being mechanically linked to said closure means so that customer translation of the closure means will automatically effect said shift of said receptacle to be operatively adjacent said ticket removal station with its contents accessible to the customer;

this ticket receiving receptacle further including automatic ticket compression means adapted and arranged to resiliently and gradually compress the ticket contents in said receptacle into a neat pack as the receptacle is shifted, being automatically actuable into, and out of, this compression mode via mechanical linkage to said closure means.

14. The combination as recited in claim 1, wherein said receiving means also includes record compression means adapted to be automatically thrust against the records in said receiving means when the closure means is opened, and to be thrust oppositely when the closure means is closed.

15. The combination as recited in claim 6, wherein this pocket means also includes record compression means adapted to be automatically thrust against the records in said bin when the closure means is opened and to be thrust oppositely when the closure means is closed.

16. The combination as recited in claim 8, wherein this pocket means also includes record compression means adapted to be automatically thrust against the records in said bin when the closure means is opened, and to be thrust oppositely when the closure means is closed.

* * * * *